US005943698A

United States Patent [19]

Blanks, I

[11] Patent Number: 5,943,698

[45] Date of Patent: Aug. 31, 1999

[54] ARTICLES HAVING INTERCHANGEABLE AND/OR REVERSIBLE IMAGES AND CONTAINERS THEREFOR

[76] Inventor: Stevenson T. Blanks, I, 1142 W. 26th St., Erie, Pa. 16508

[21] Appl. No.: 09/072,682

[22] Filed: May 5, 1998

Related U.S. Application Data

[60] Provisional application No. 60/045,601, May 5, 1997.

[51] Int. Cl.[6] ..... A41B 1/00

[52] U.S. Cl. ..... 2/69; 40/586; 2/115

[58] Field of Search ..... 2/69, 115, 108, 2/102, 85, 94, 93, 246, 247, 248, 250, 252, 253, 106, 105; 40/586

[56] References Cited

U.S. PATENT DOCUMENTS

| | | | |
|---|---|---|---|
| 159,112 | 1/1875 | Mueller | 2/144 |
| 1,467,680 | 9/1923 | Oda . | |
| 2,589,409 | 3/1952 | Leichter | 2/106 |
| 2,871,485 | 2/1959 | Greco | 2/246 |
| 2,986,743 | 6/1961 | Eilen . | |
| 3,055,133 | 4/1962 | Anderson | 2/102 |
| 3,582,993 | 6/1971 | Keller | 40/586 |
| 4,202,053 | 5/1980 | Bell . | |
| 4,389,801 | 6/1983 | Sharrock . | |
| 4,625,337 | 12/1986 | Zahn . | |
| 4,924,613 | 5/1990 | Levin . | |
| 5,023,956 | 6/1991 | Fox | 42/586 |
| 5,073,987 | 12/1991 | Crosier . | |
| 5,548,847 | 8/1996 | Spicijaria . | |
| 5,636,385 | 6/1997 | Harrison | 2/244 |
| 5,704,067 | 1/1998 | Brady | 40/586 |

*Primary Examiner*—Gloria Hale
*Attorney, Agent, or Firm*—Daniel A. Sullivan, Jr.

[57] ABSTRACT

An article, such as an apparel, bears a laminated image in a transparent window. The article has, for instance, a transparent window on the outside and an opening inside for inserting an image-bearing panel into a pouch for displaying the image through the window. The article may be reversible, in which case it may carry a panel having images on two sides, the panel being visible through transparent material either inside or outside the apparel.

18 Claims, 25 Drawing Sheets

ARTICLES HAVING INTERCHANGEABLE AND/OR REVERSIBLE IMAGES AND CONTAINERS THEREFOR

CROSS-REFERENCE TO RELATED APPLICATION

The benefit of provisional application No. 60/045,601 filed May 05, 1997 is claimed. Provisional application No. 60/045,601 filed May 05, 1997 is incorporated here by reference.

FIELD OF THE INVENTION

This invention relates to articles made of fabric materials, and particularly to improvements in apparel, especially apparel carrying variable images.

SUMMARY OF THE INVENTION

It is a specific aim of the present invention to offer innovative designs and construction whereby laminated paper panels bearing images, such as logos, patterns, indicia or pictorial matters, can be quickly and easily integrated with a selected apparel, and in like fashion can be readily removed, reversed or interchanged.

A further goal of this invention is the provision of a means for inserting and removably containing an interchangeable and reversible paper panel section which has been laminated with a clear, transparent plastic coating.

Another goal of this invention is the provision of a means for protecting paper images within a container having a clear, transparent plastic window. According to the invention, the paper images are completely encased by laminating, thereby protecting them from wear, tear and the like. The paper images or cards are protected from being wrinkled, torn, or getting wet from rain, sweat, moisture, etc., which could otherwise cause them to fade or become distorted. Also, with lamination, paper images become stiffer and better amenable to correct orientation within the confines of the container, so that the picture appears upright through the window, rather than appearing rotated toward one direction or the other.

These and other goals of the invention are accomplished by providing an apparel that allows a laminated paper panel section bearing image, logo or pictorial matters to be displayed through a picture or window frame-like container. This innovative feature will permit the wearer of the select apparel to display any known logo to depict loyalty and fashion or some type of expression, which can range from pictures or photos of movie, music or sports stars; friends or family, slogans, or any artistic, imprinted designs. Because of the innovative designs and constructions of the present invention, the apparel will always remain fresh and keep pace with tomorrow's fashion trends and demands.

This feature would also cause an on-looking viewer to think that you have many versions of an apparel bearing different images, when in reality you have only one apparel having interchangeable and reversible laminated paper panel sections bearing various images that will cause a slight modification in the appearance of the apparel.

Overall results will be:

1) There will not necessarily be a need for using a two-part affixing means to secure a panel or patch onto an desired section of an apparel, such being time consuming and expensive.
2) Reducing the expenses of manufacturing panels or patches bearing customized imprints and a means for containing them.

As was stated above, this present invention is constructed in an incomparable manner. The apparel can incorporate one or more interchangeable and reversible laminated paper panel sections bearing imprints on each side for two side usage. The apparel and its interchangeable and reversible laminated paper panel sections bearing imprints utilize a picture-like framing means of containment, which in turn likewise aids in achieving interchangeability, reversibility and, lastly, alterability. This will permit a user of the apparel to implement the interchangeable and reversible, laminated paper panel sections for a particular purpose or event and to interchange and/or reverse those sections from the apparel and to install another one within it.

Preferably, the laminated paper panel is visible through a transparent material attached, directly or indirectly, on or in an opaque, or at most translucent, fabric of the apparel.

While the invention is primarily disclosed for application to apparel, it will be appreciated that it applies more broadly to other items, such as fabric gym bags, suitcases, clothes bags, duffel bags, etc.

BRIEF DESCRIPTION OF THE DRAWINGS

In order to fully illustrate the present invention, I have shown in the accompanying drawings, various views of the present invention, which I will now describe.

DETAILED DESCRIPTION OF THE INVENTION

Figure 1:
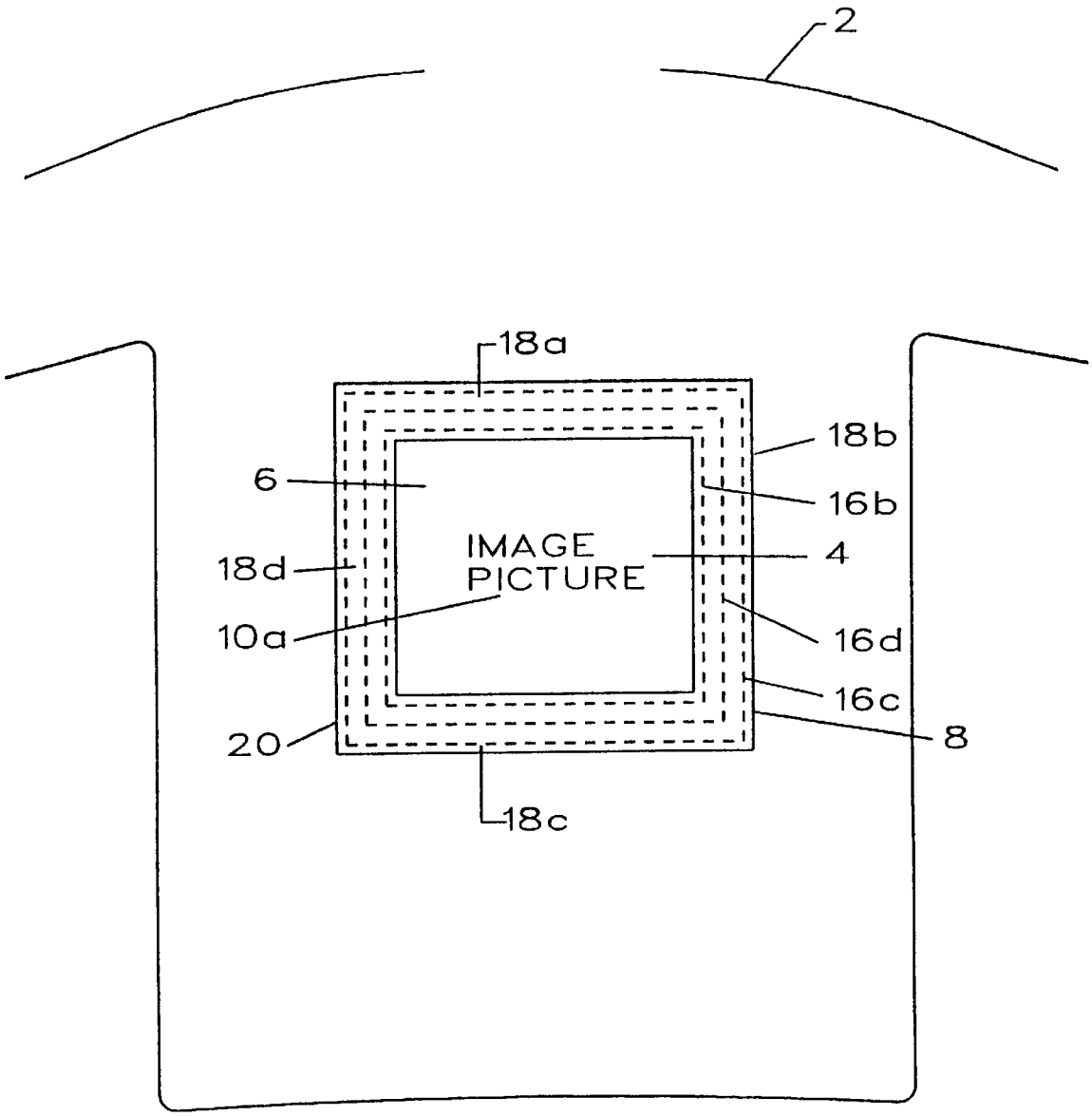
FIG. 1 shows a back view of an apparel (e.g. jersey), illustrating a laminated paper panel bearing an image or picture displayed through a picture or window frame-like container.

Referring now to the drawings, wherein like numerals denote like elements, the drawings illustrate examples of how the present invention is applied to an apparel (e.g. jersey).

In FIG. 1, the back of the apparel (e.g. jersey) 2 is shown having an interchangeable and reversible, laminated paper panel section 4 bearing an image, such as a picture, indicia or logo 10*a,* displayed through a sheet of clear, transparent and flexible material 6 (to be described below) affixed to the opaque material of the apparel. The laminated paper panel section 4 contains imprints 10*a* and 10*b* (10*b* is hidden behind 10*a* in FIG. 1) on each side for the purpose of two-side usage.

Further with reference to FIG. 1, a picture frame container 8 is permanently affixed onto a desired section of an apparel (e.g. jersey) 2, so that a laminated paper panel section 4 bearing an image, such as logo or pictorial, 10*a* can be inserted within an inner pocket or pouch of the container 8 for the purpose of displaying the laminated paper panel section 4 through material 6.

In order to comprehend the design and construction of the example of the present invention displayed in FIG. 1, FIGS. 2A–2E should now be carefully viewed and studied.

Figure 2A:
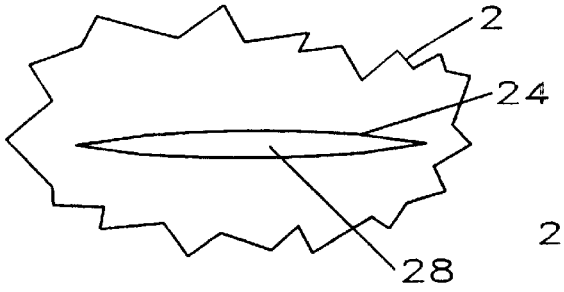
FIGS. 2A–2E are enlarged, fragmentary views, which illustrate process steps for making a container to carry the laminated paper panel section.
Figure 2B:
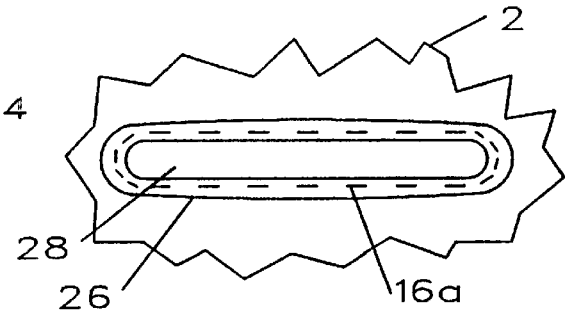

FIGS. 2A–2E illustrate one of the various ways the present invention can be designed and constructed, more particularly using the frame-like container 8, which carries the laminated paper panel section 4. FIGS. 2A and 2B exhibit partial views of an apparel (e.g. jersey) 2 as having a horizontal cut 24 of a desired length. This horizontal cut 24 made into the apparel (e.g. jersey) 2 is of much significance, as will be described below. After the cut 24 is made, a border 26 of desired fabric is placed and positioned around the raw edges of the cut 24 and then stitched with a line of stitching 16*a* along the edge.

Figure 2C:
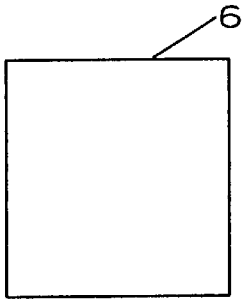
Figure 2D:
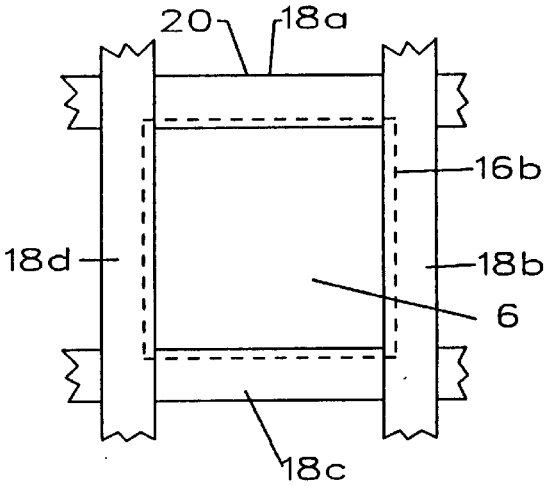
Figure 2E:
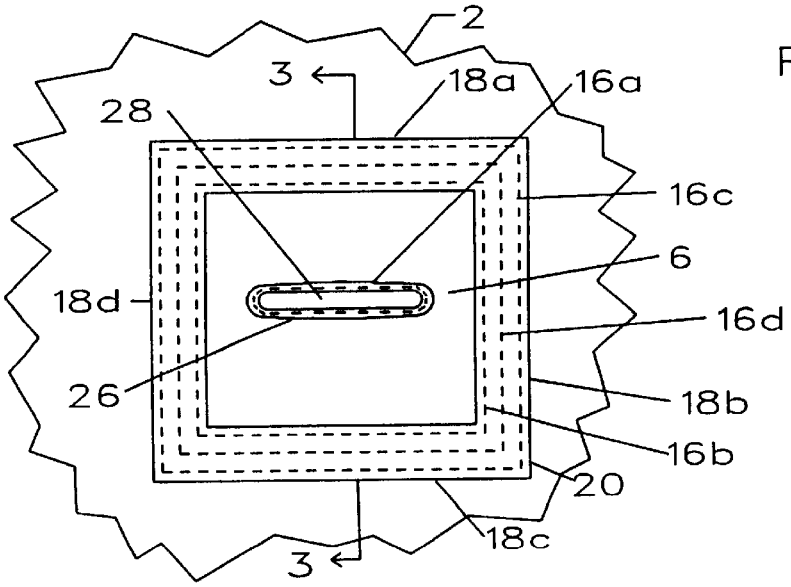

As shown in FIG. 2C, a piece of clear, transparent and flexible sheet material 6 is cut into a square shape to desired measurements bigger than the cut 24. Then four strips of fabric ribbon 18*a,* 18*b,* 18*c* and 18*d* are cut longer, for instance 11-inches longer, than the sides of the flexible sheet material 6, in order that there be some extra length to fold under, as will be related below. The four fabric ribbon strips 18*a,* 18*b,* 18*c* and 18*d* edges are then placed on top of the clear, transparent and flexible sheet material 6 along its side edges (FIG. 2D). Afterwards each of them are stitched with a line of stitching 16*b* along the border as seen in FIG. 2D. The four ribbon strips preferably contrast with material 6, in order to give the appearance of a frame around the transparent window of material 6. For instance, the ribbon strips may be opaque and have color. When finished, a square shaped frame 20 is formed around the outer edges of the square shaped clear, transparent and flexible sheet material 6 (FIG. 2D). The finished picture or window frame 20 at this time can be permanently affixed onto the back of the apparel (e.g. jersey) 2 as seen in FIGS. 1A or 2E. Methods for affixing the finished frame 20 will now be addressed.

Figure 3:
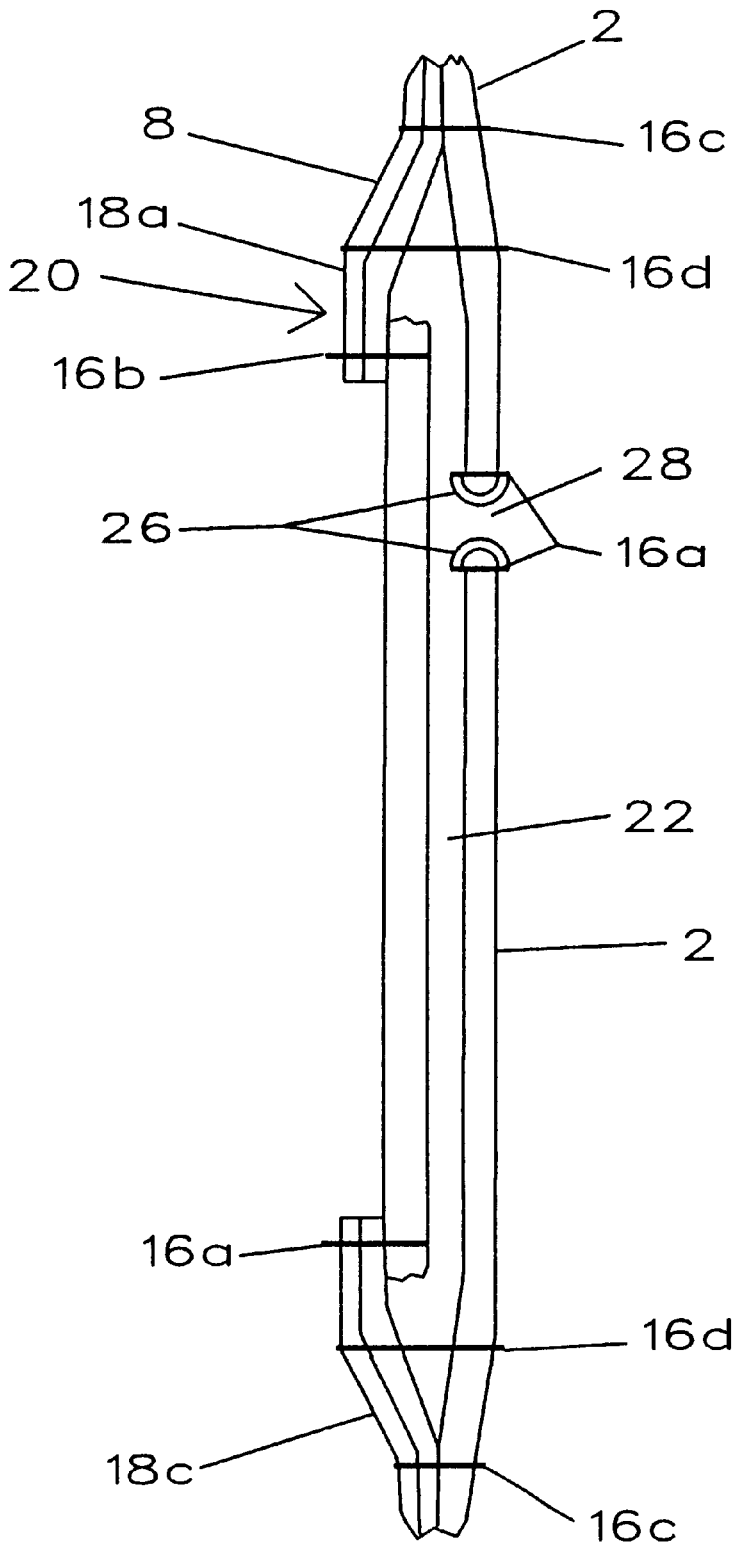
FIG. 3 is a sectional view of FIG. 2E taken on line 3—3, on an enlarged scale.

After the frame 20 is finished, it can be placed on any suitable location of the apparel (e.g. jersey) 2. FIGS. 1A and 2E shows the frame 20 as being permanently affixed onto the back section of an apparel (e.g. jersey) 2. The picture or window frame 20 is permanently affixed by a line of stitching 16*c* in a circumferential manner along the borderline outside edges of the fabric ribbon 18*a*–18*d,* after the free, raw ends of the fabric ribbon have first been folded downwards and inwards, and tucked between the surface of the apparel (e.g. jersey) 2 and fabric ribbon strips 18*a*–18*d,* as shown in FIG. 3. Another line of stitching 16*d* is then stitched in circumferential, rectangular manner at the center of the strips of fabric ribbon 18*a*–18*d* (FIG. 2E).

Figure 5A:
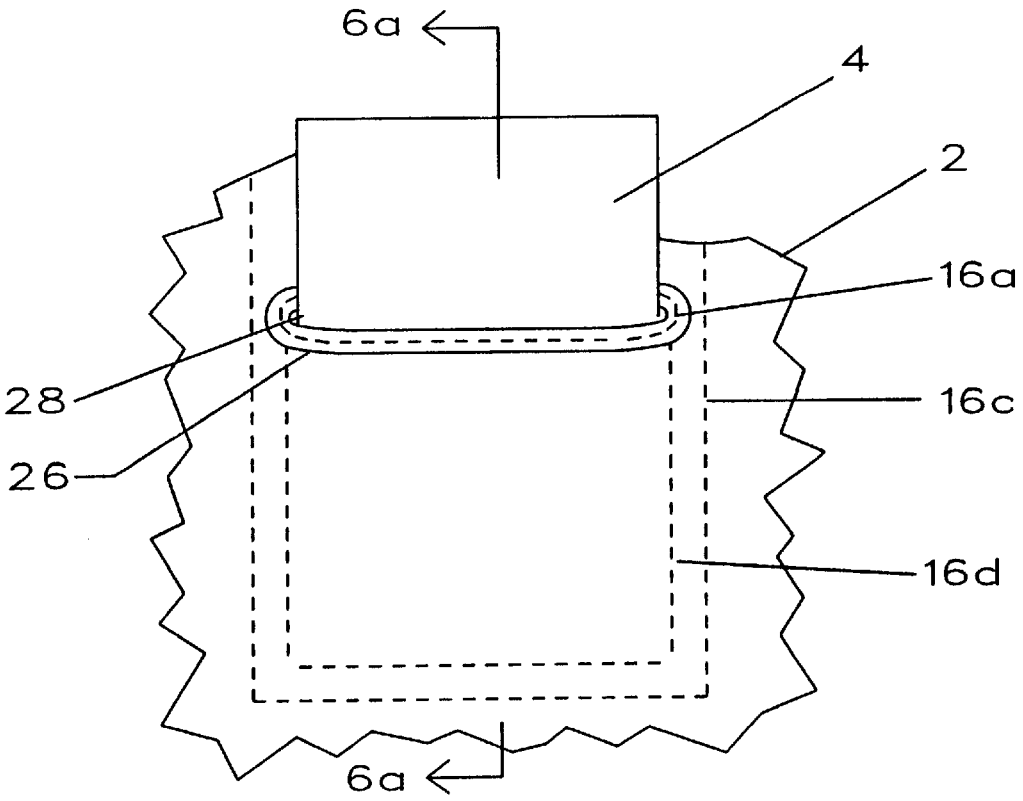
FIGS. 5A–5B are elevational views of the inside of an apparel (e.g. jersey) showing how a laminated paper panel section is inserted within the inner entrance to a pocket or pouch prepared as in FIGS. 1–3.
Figure 5B:
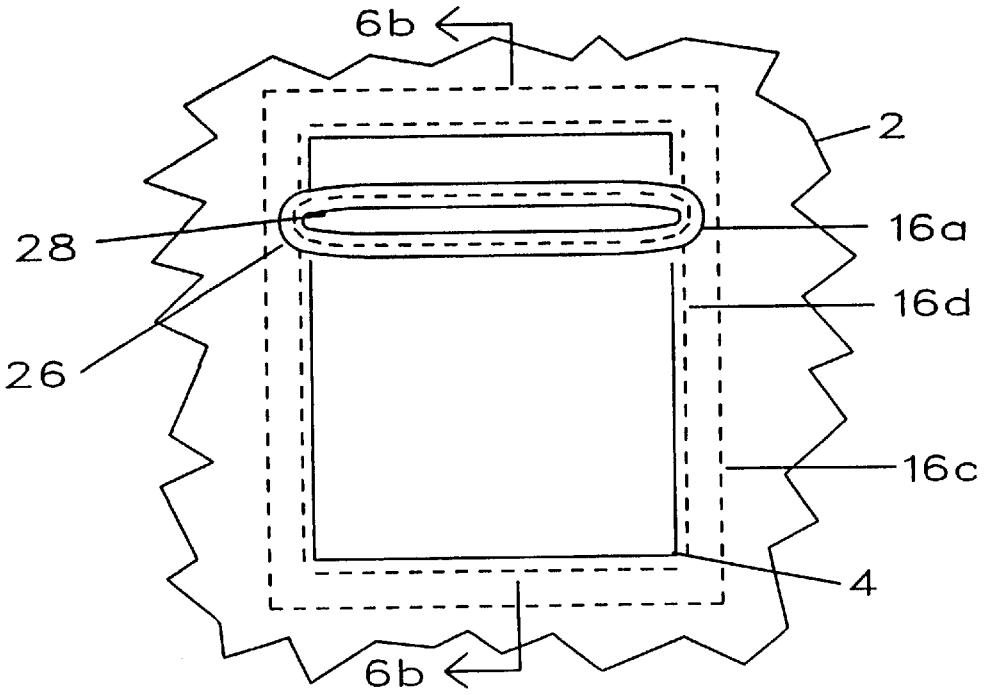

When stitching 16*d* is completed, an inner pouch or pocket 22 is created, being contained between frame 20 and the outer section of the apparel (e.g. jersey) 2 (FIG. 3). The inner pouch or pocket 22 is for admitting and containing a laminated paper panel section 4. Stitching 16*d,* located in the center of the fabric ribbon strips 18*a*–18*d,* is almost the same identical size as the laminated paper panel section 4 (FIGS. 5A–5B). This is done so that there is a perfect alignment and fit when the panel section 4 is inserted, as seen in FIGS. 5A–5B, inside the opening 28 of the inner pouch or pocket 22. Because of the tight fit, panel 4 is held in place, and cannot rotate about an axis perpendicular to the plane of the panel into positions out of alignment with the lines of the apparel.

A further very important element of this present invention, more particularly with respect to the inner pocket or pouch section 22, is the capability of storing one or more panel sections 4 within pocket 22. This permits the user of the apparel (e.g. jersey) to carry one or more panel sections 4 within the inner pocket or pouch 22 where ever the user goes, and when ever the user of the apparel (e.g. jersey) desires to display a particular panel section 4 for whatever reasons, the user may do so by simply inserting the panel section 4 that is to be displayed in front of the other panel sections 4 (not shown).

Figure 4A:
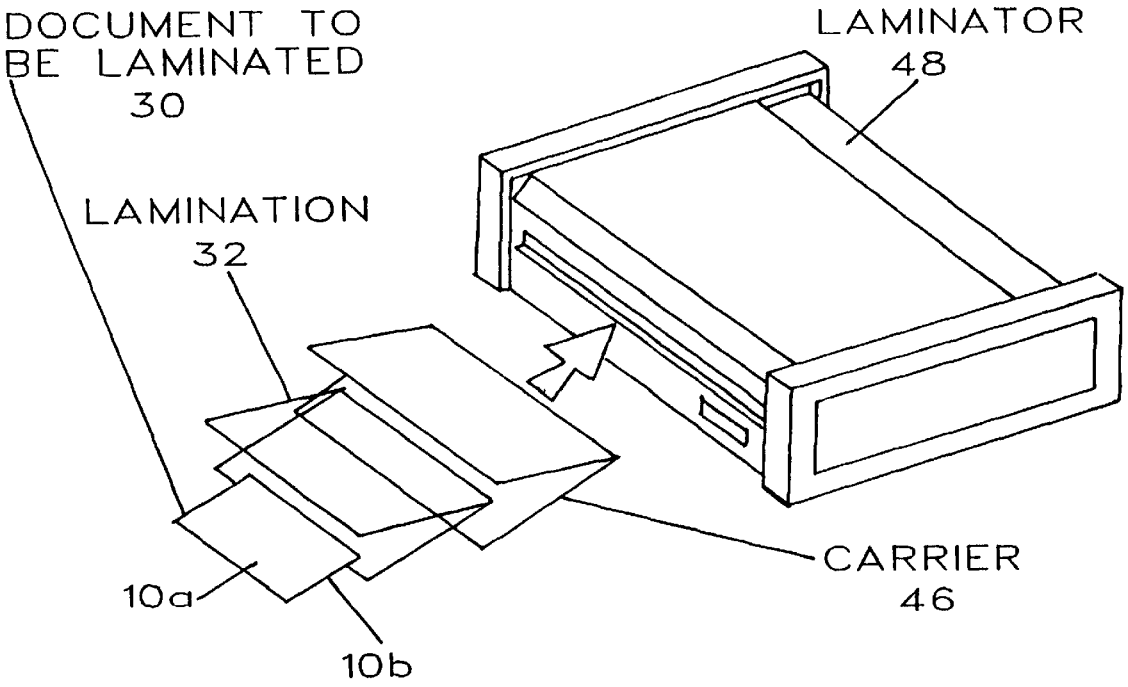
FIGS. 4A, 4B and 4C illustrate steps for preparing an interchangeable and reversible, laminated paper panel section for installation within the container.
Figure 4B:
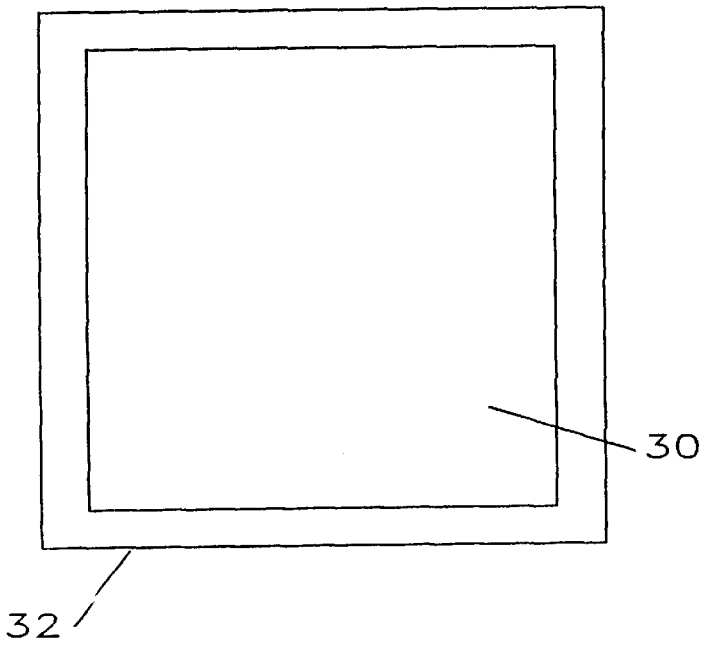
Figure 4C:
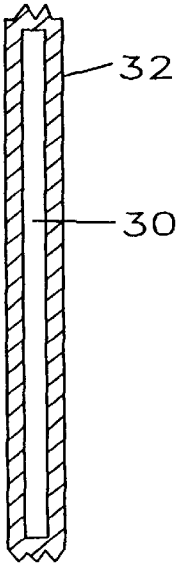

FIGS. 4A–4C illustrate briefly the process of how a laminated paper panel section 4 is prepared. A piece of paper, or other laminatable material, 30 of desired length, width and thickness, bears an image on one or both sides, an image such as a logo, picture, pattern or indicia 10*a* and 10*b*. Paper 30 is placed within a laminating pouch 32 of clear, transparent, plastics material. Then the laminating pouch is placed inside of carrier 46. The temperature is set on the laminating machine 48 to a proper setting so that the paper 30, with the images 10*a* and 10*b* on each side, has a smooth, crystal-clear finish after it is laminated. Rather than laminating machine 48, a mass production laminating machine can be used, where it is desired to produce laminated images in large quantities.

An example of suitable laminating pouch material is that sold under the GBC DOCUSEAL label by General Binding Corporation of North Brook, Ill. This material has a smooth surface and comes in 3, 5, 7, 9 and 11 mil thicknesses. The 3-mil thickness is suitable for preparing laminated paper panel sections 4, which are carried in transparent containers on the chest section of an apparel. Thicker material, in the 5 to 9-mil range, is preferred when the sections 4 are placed in transparent containers on the back of an apparel, because the greater thickness guards against damage to the section 4, when one leans back against the back of a chair, for instance. Laminating pouch material with a textured surface, for instance a surface having small V-shaped grooves, may also be used.

Another noteworthy element of the present invention concerns more particularly the laminated paper panel section 4. When the paper 30 is properly laminated, it will be completely weather proof, which means that the laminated paper panel section 4 can be worn with an apparel in all types of weather without being harmed by the weather. It adds positive protection to any printed piece of paper. Laminations defy aging, grime, spills, water, sweat, oil, gas, chemicals and abrasion. This is possible, because, when the paper 30 is laminated, the lamination process completely seals it.

After the frame 20 is fastened onto the back section of the apparel (e.g. jersey) 2, a laminated paper panel section 4 can now be inserted within the opening 28 of the inner pouch or pocket 22, from inside of the apparel (e.g. jersey) 2 as seen in FIGS. 5A–5B, 6A–6B. When the frame 20 is fastened onto the back section of the apparel (e.g. jersey), the frame 20 becomes a container, thus a picture frame container 8. This term is used, because, when the picture frame 20 is properly fastened onto the apparel (e.g. jersey) 2, an inner pocket or pouch 22 is created. This inner pocket or pouch 22 is a container for receiving and containing an interchangeable and reversible, laminated paper panel section 4 (FIGS. 5A–5B, 6A–6B).

Figure 6A:
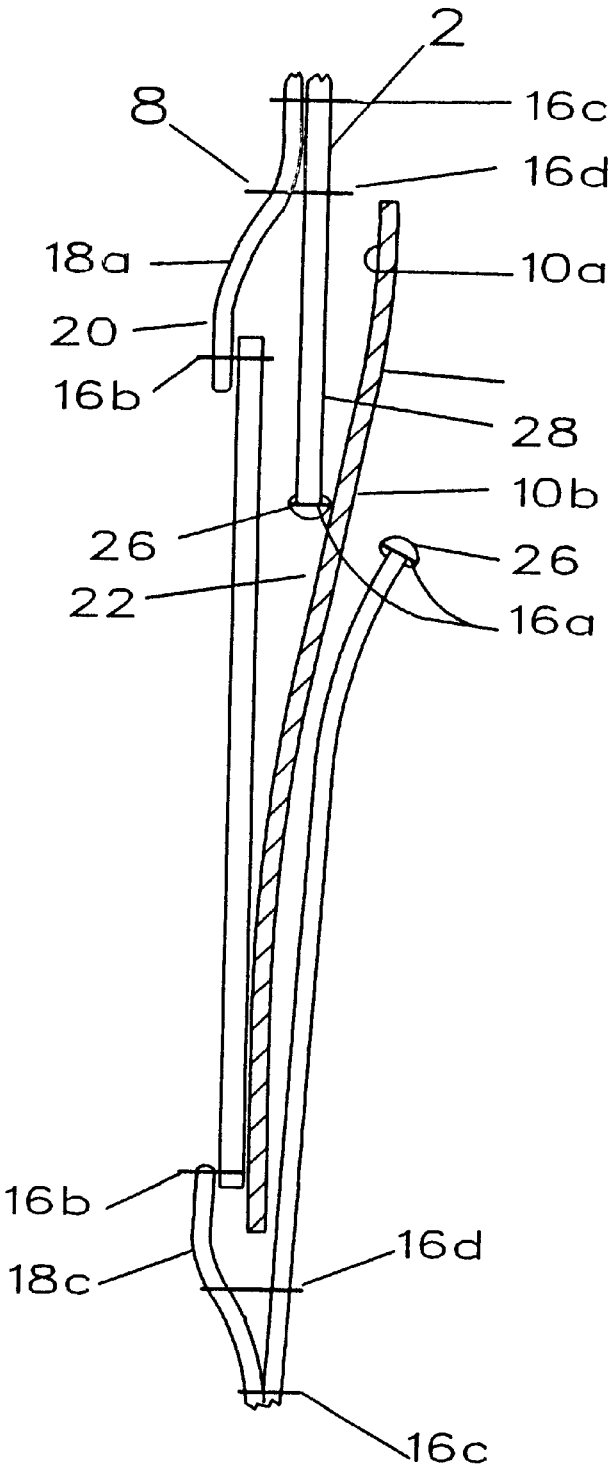
FIGS. 6A–6B are sectional views of FIGS. 5A–5B taken on lines 6*a*—6*a* and 6*b*—6*b* of those Figs., on an enlarged scale.
Figure 6B:
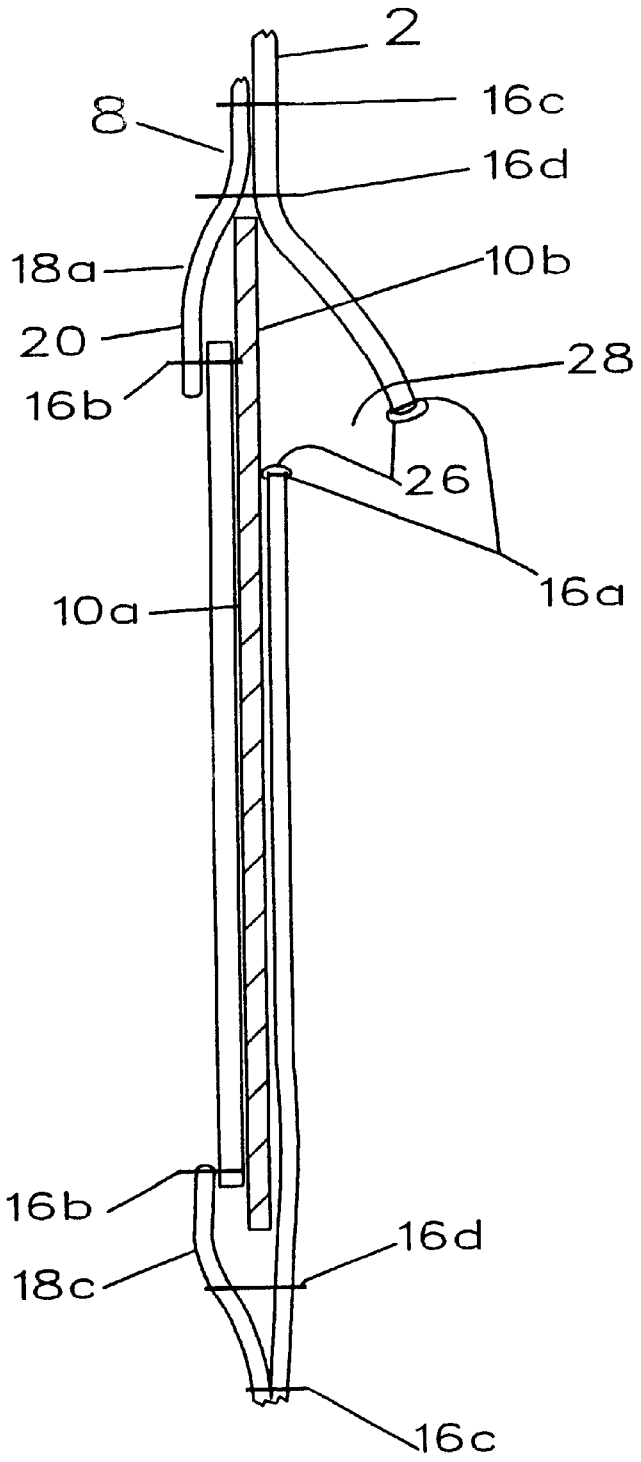

Inserting the laminated paper panel section 4 is very simple. All one has to do is insert the panel section 4 into the opening 28 of the inner pouch or pocket 22 located on the inside of the apparel (e.g. jersey) 2, as seen in FIGS. 5A–5B, 6A–6B. The top, bottom and vertical side edges of the panel section 4 should rest against the top, bottom and vertical sides of stitching 16*d* (FIGS. 5A–5B, 6A–6B). After the panel section 4 is correctly inserted into the region of the pocket or pouch 22 below opening 28, the portion of the pocket or pouch 22 above opening 28 is then pulled over the top of the panel section 4 (FIGS. 5A–5B, 6A–6B). When finished, the panel section 4 should show image 10*a* through the clear, transparent and flexible sheet material of the picture or window frame. Pulling the top of the opening 28 of the pocket or pouch 22 over the laminated paper panel section 4 helps to keep the laminated paper panel section 4 from coming out of pocket or pouch 22, as seen in FIGS. 5B, 6B.

Since the laminated paper panel section 4 is interchangeable and reversible, you can remove it from the inner pouch or pocket 22, afterwards interchange the panel section 4 for another panel section, or instead of interchanging the panel section for another one, reverse panel section 4 by taking it out of the inner pouch or pocket 22, afterwards turning it around, then insert it back within the inner pouch or pocket 22, so that the image 10*b* is now showing.

Figure 7:
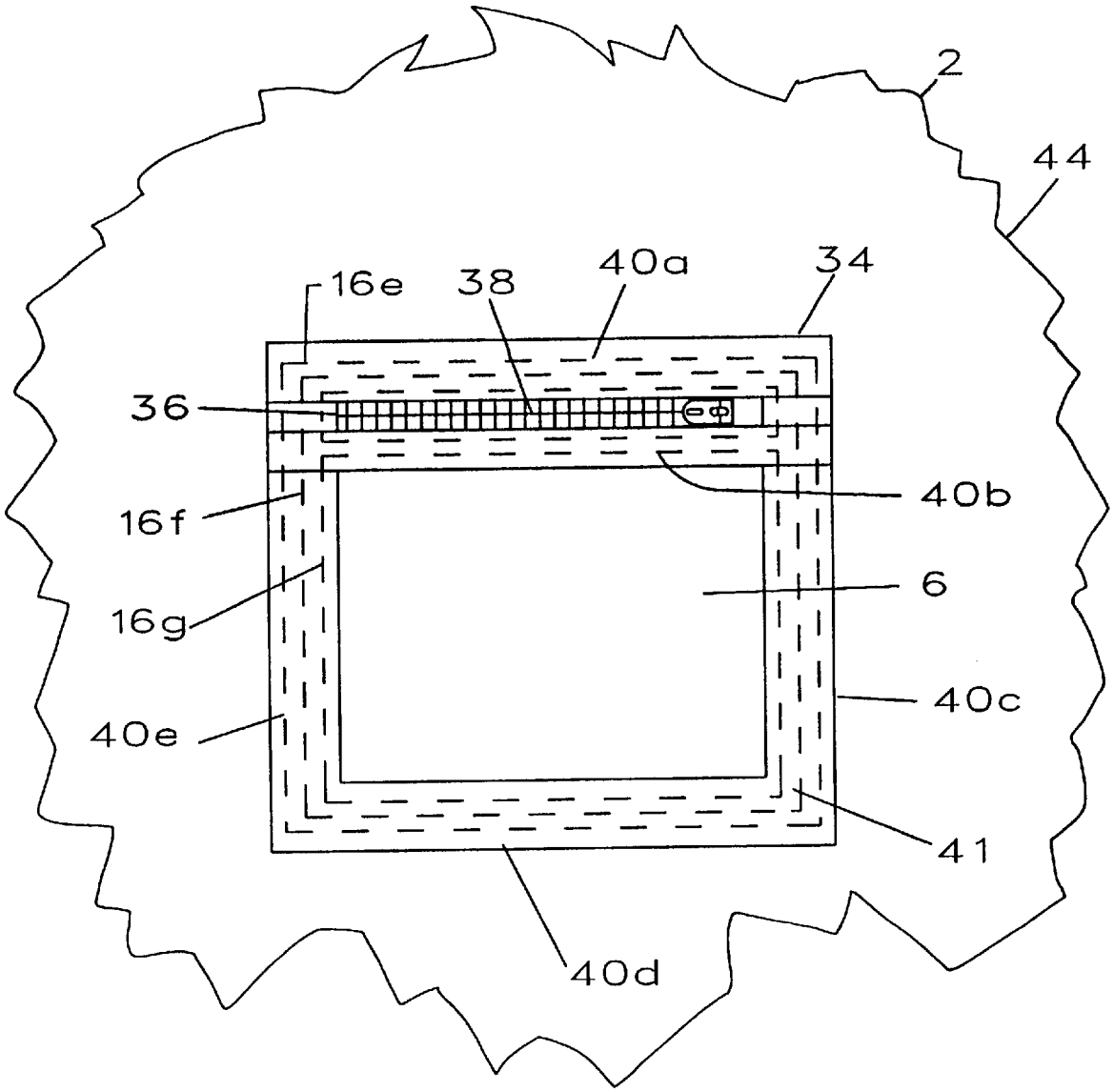
FIG. 7 shows an elevational view of an alternative design and construction of the present invention, more specifically a completed container which carries the laminated paper panel section.
Figure 8:
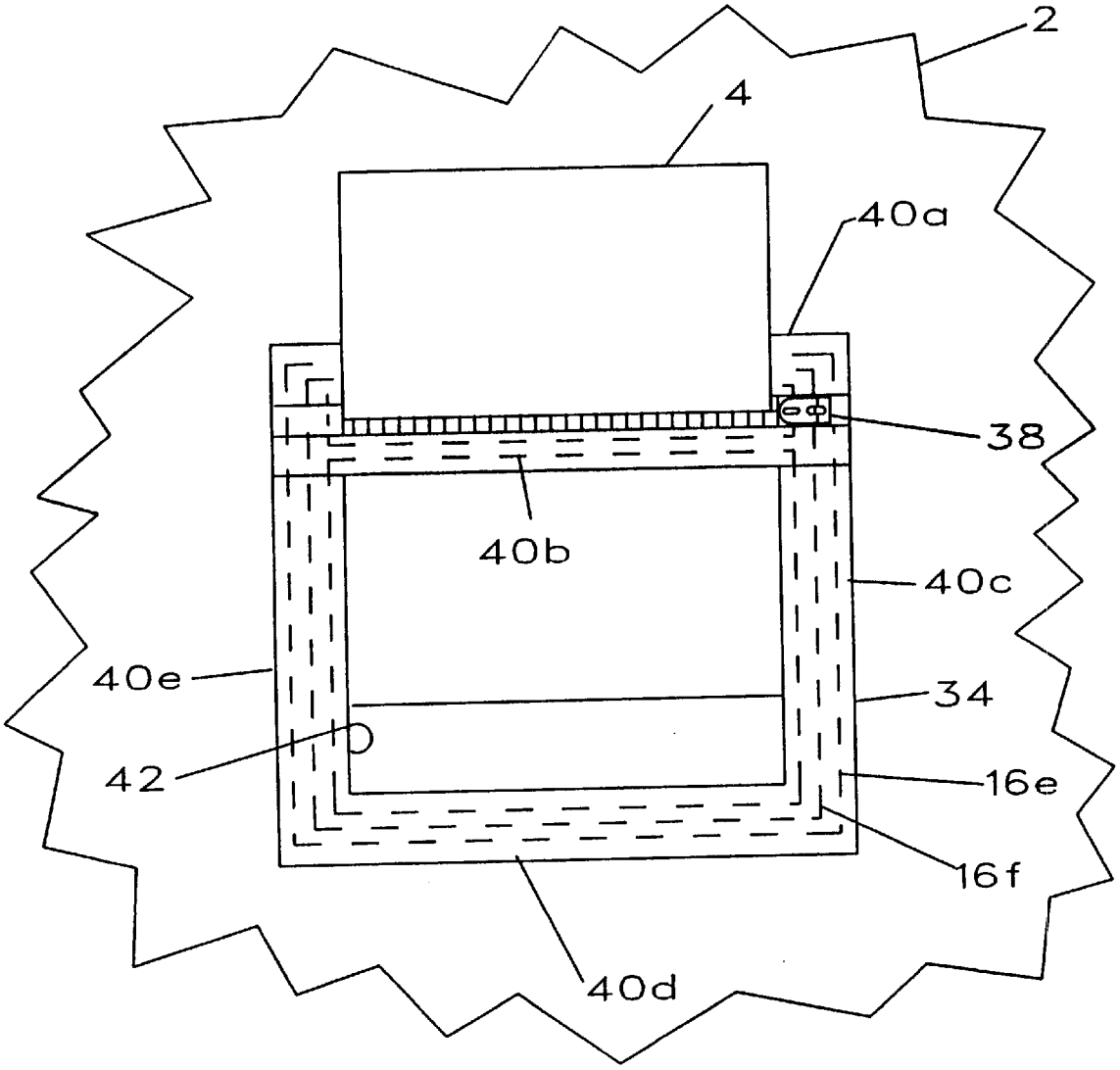
FIG. 8 is a view as in FIG. 7 showing a laminated paper panel section being inserted within the opening of the picture frame container.

FIGS. 7 and 8 illustrate another way of designing and constructing a picture frame container like container 8 of the previous Figures. This picture frame container 34 is fashioned similarly to the respected above picture or window frame container 8 (FIGS. 2A–2E), with line of stitching 16*g* securing ribbon strips 40*b–e* to the edges of transparent window 6, in order to create window frame 41. FIG. 7 shows a zipper 36 being employed, sewn between ribbon strips 40*a* and 40*b* and located along the sides of the opening 38 of picture frame container 34. When the picture frame container 34 is completed, it is then placed onto the back section of the apparel (e.g. jersey) 2, afterwards stitched with a line of stitching 16*e* around the borderline edges (as shown in FIG. 7). When stitching 16*e* is finished, all four sides of the picture frame container 34 will be completely sewn in a circumferential manner. Another line of stitching 16*f* is then added in the center of the fabric ribbon strips 40*a* and 40*c*–40*e*. When stitching 16*f* is completed, an inner pocket or pouch 42 is created, being enclosed between the picture frame container 34 and the outer section of the apparel (e.g. jersey) 44. Stitching 16*f* is almost the same identical size of the laminated paper panel section 4. This is done so that there is a perfect fit when the panel section 4 is inserted inside the opening of the inner pocket or pouch 42.

With this design and construction, a laminated paper panel section 4 can still be easily removed, interchanged or reversed, and afterwards installed back within the inside of the inner pocket or pouch 42, by opening and closing the zipper 36, as shown in FIG. 8.

FIGS. 9A–9F, 10A–10D, 11 and 12A–12B as depicted, illustrate a modified version of the present invention, more particularly involving the use of a two-part fastening means, for the purpose of incorporating a removable and replaceable, clear, transparent and flexible sheet material, which is to be described hereafter.

Figure 9A:
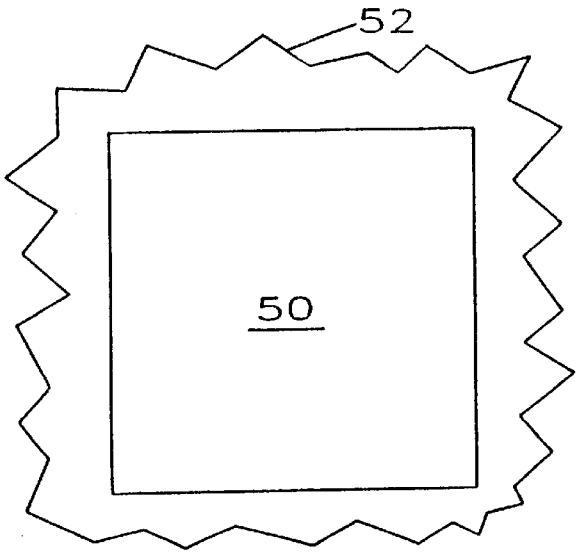
FIGS. 9A–9F show alternative method steps of designing and constructing the present invention, more specifically the picture frame container.
Figure 9B:
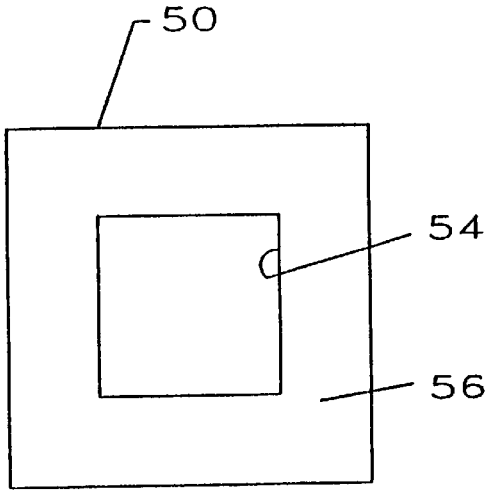
Figure 9C:
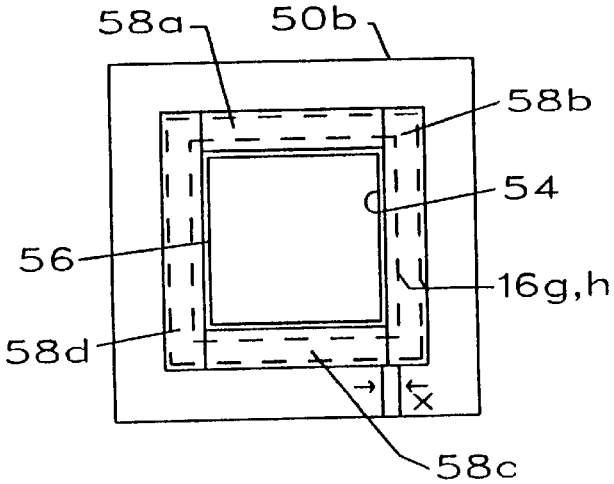

A square-shaped panel 50 of a desired measurement is circumferentially cut from a desired non-fraying fabric 52, such as leather or vinyl. Then a square cut-out orifice 54 is made in the center of the square panel to form a square fabric frame 56, as shown in FIGS. 9A–9B. Next, in FIG. 9C the "hooks-part" segments 58*a*–58*d* of a two-part affixing fabric bands of hooks and loops, for instance VELCRO fastener bands, cut to desired measurements (four lengths as shown), and coated with fabric glue, such as Weldbond glue, on their back side, are each placed onto the surface of the fabric 50, spaced a desired distance X away from the square-shaped orifice 54. Additionally, as shown in FIG. 9C, the bands of hooks 58*a*–58*d* are afterwards stitched with stitching 16*g* and 16*h* along their edges as seen. The VELCRO bands 58*a*–58*d* (affixing means) as shown, when placed and permanently affixed onto the surface of the fabric 50 away from the borderlines, forms a square shape similar to that of the cut-out orifice 54.

Figure 9D:
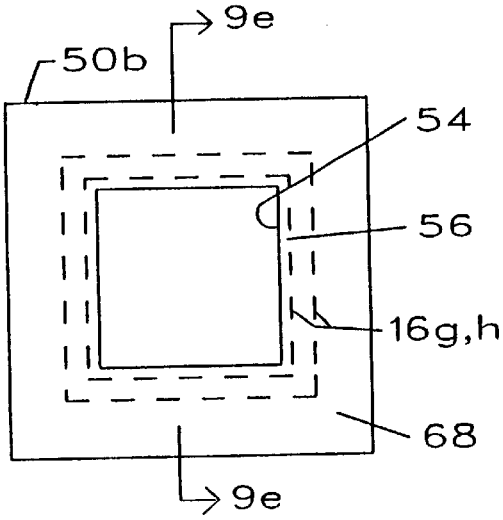

FIG. 9D shows the resulting assembly from the front side. This Fig. shows a view onto the outside face of the square frame 56. As seen, the hook parts 58*a*–58*d* of the two-part affixing bands are hidden from view after they are stitched with stitching 16*g* and 16*h* to the back surface of the fabric 50.

Additionally, when the hooks-part of the fastening means is permanently affixed onto the back surface of the square frame 56, it becomes what I have termed to be a picture frame container 68. This term is used because it contains an underlying container, or cassette, 62, which will be described below.

Figure 9E:
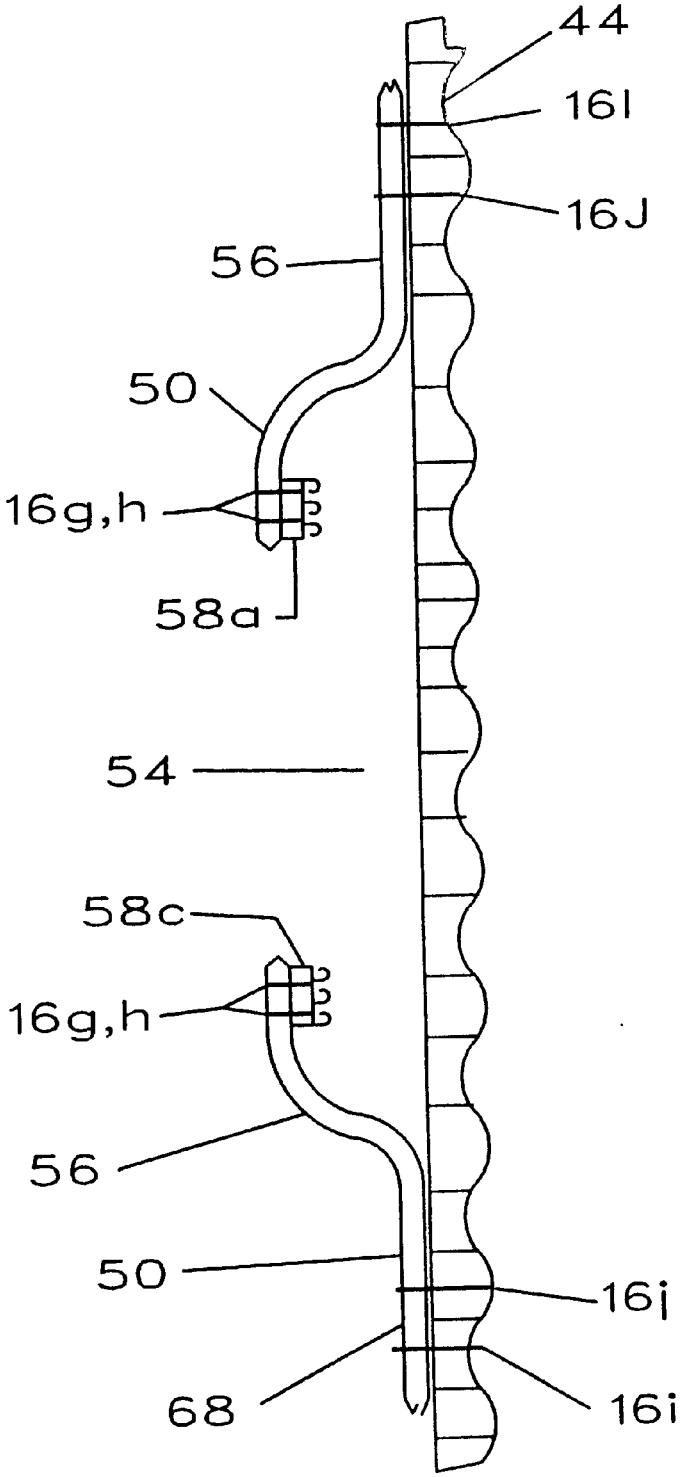
Figure 9F:
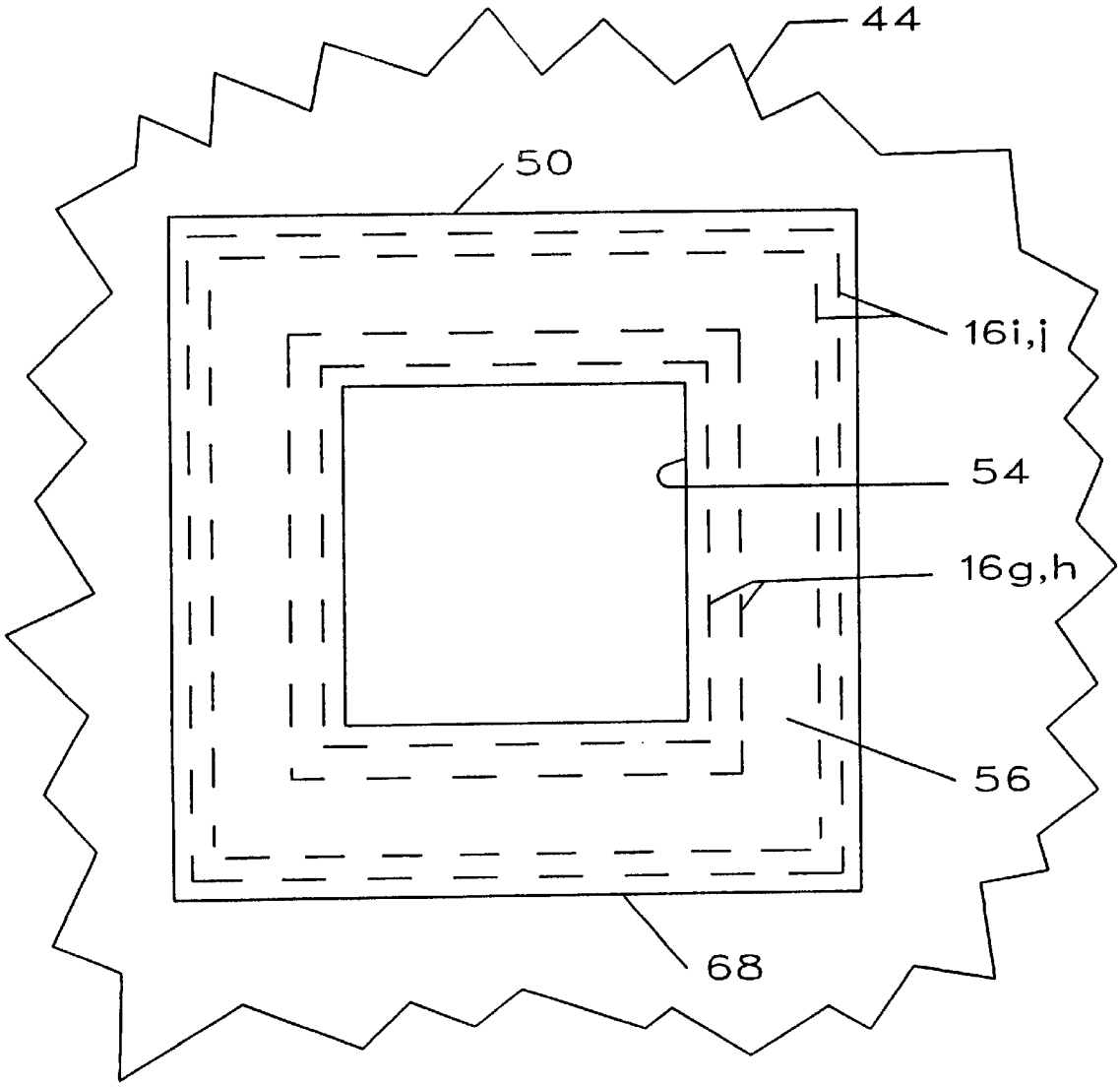

The picture frame container 68 can at this point be positioned and placed onto a suitable location of a desired apparel 44 as seen in FIGS. 9E and 9F, and afterwards joined to the fabric of the apparel with a line of stitching 16*i*. It is preferable to sew a second row of stitching 16*j* in a circumferential manner ¾ to 1½ inches above the borderlines of the square shaped orifice 54. Stitching 16*j* joins the apparel 44 and the picture frame container 68 together. It also helps to aid and add strength to the picture frame container 68. The functions of the orifice 54 and the picture frame container 68 are for admitting, affixing and enveloping interchangeable and/or reversible, paper laminated panel sections 4 bearing imprints 10*a*–10*b*.

Figure 10A:
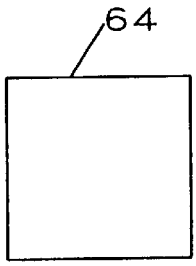
FIGS. 10A–10D are enlarged, fragmentary views, that illustrate process steps for making an underlying container.
Figure 10B:
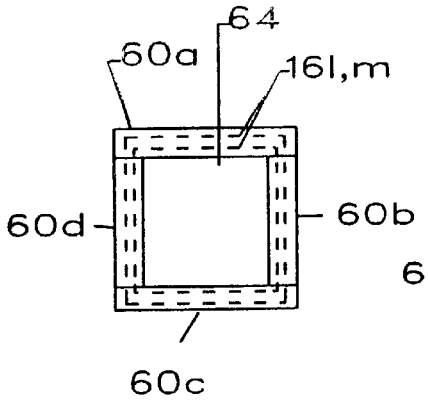
Figure 10C:
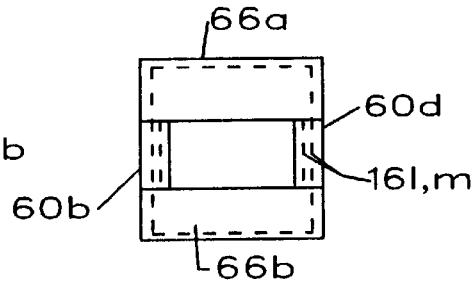
Figure 10D:
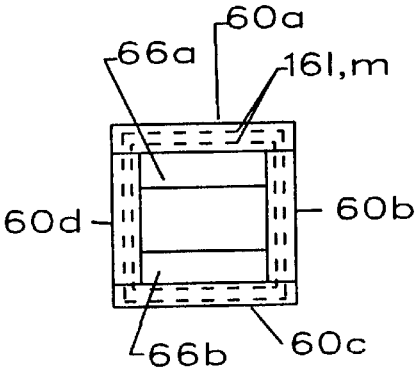

FIGS. 10A–10D illustrate steps for designing and constructing an underlying container, or cassette, 62. VELCRO (two part affixing means) bands, this time in the form of four "loops-part" segments 60*a*–60*d* of desired measurement, are supplied with glue on their backsides and afterwards placed and pressed along the border on the frontside of the square-shaped, clear, transparent and flexible sheet material 64. Additionally, the VELCRO segments 60*a*–60*d* (four of them) on the borderlines are then sewn in a circumferential manner with two lines of stitching 16*l* and 16*m*. When finished, a similar square shape has been fashioned to match the size and square shape of the orifice 54 on the picture frame container 68 (FIGS. 9C and 10D).

Figure 11A:
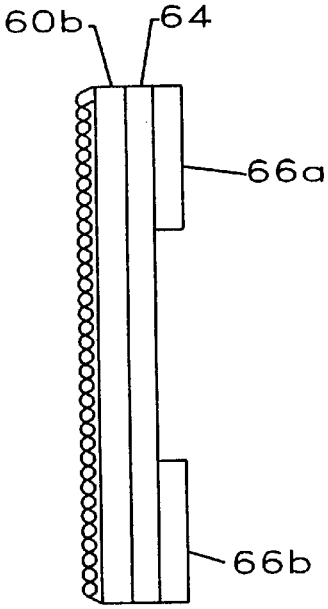
FIG. 11A is a side view of the finished underlying container.

Next, two pieces of clear, transparent and flexible material 66*a* and 66*b* are cut to desired length and width, and, afterwards, they are positioned and bonded onto the borders of the other side of the clear, transparent and flexible sheet material 64 as seen in FIG. 10C. The two pieces 66*a* and 66*b*, when bonded in place, form holding slots at the top and bottom of material 64 for holding a panel section 4. The resulting underlying container is shown in FIG. 11A in side view and in FIG. 11B in front view.

Figure 10E:
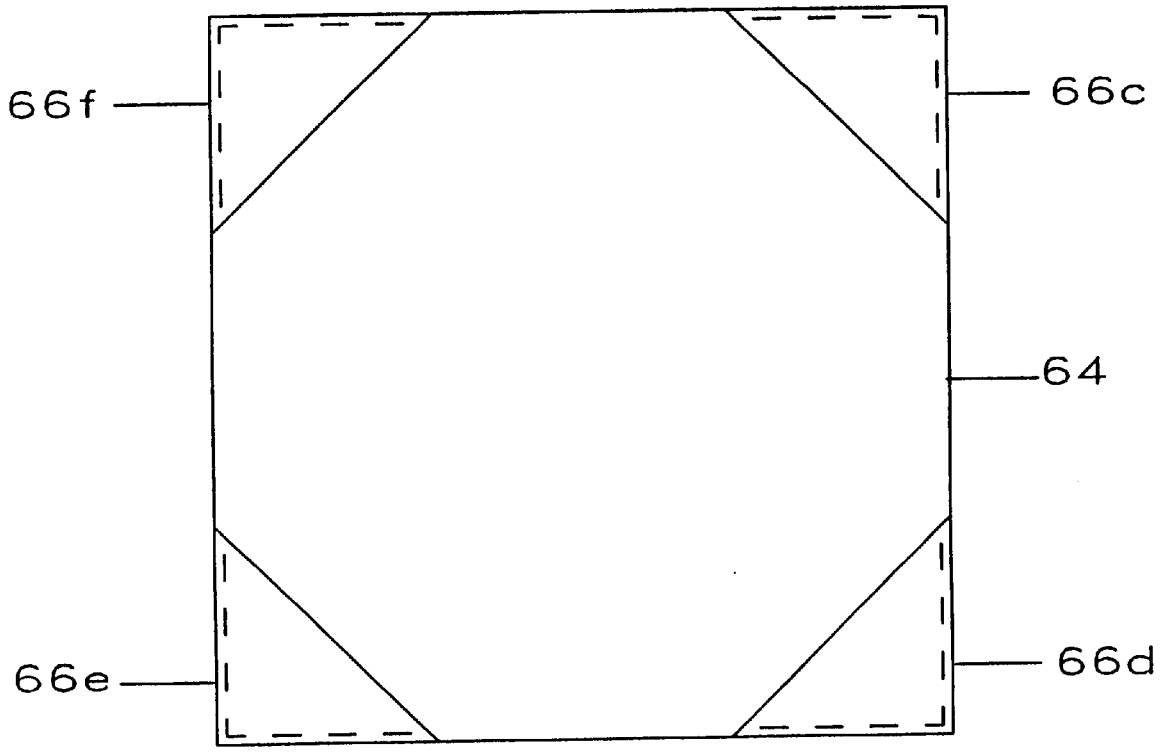
FIG. 10E is a view as in FIG. 10C of an alternative to the construction displayed in FIG. 10C.
Figure 11B:
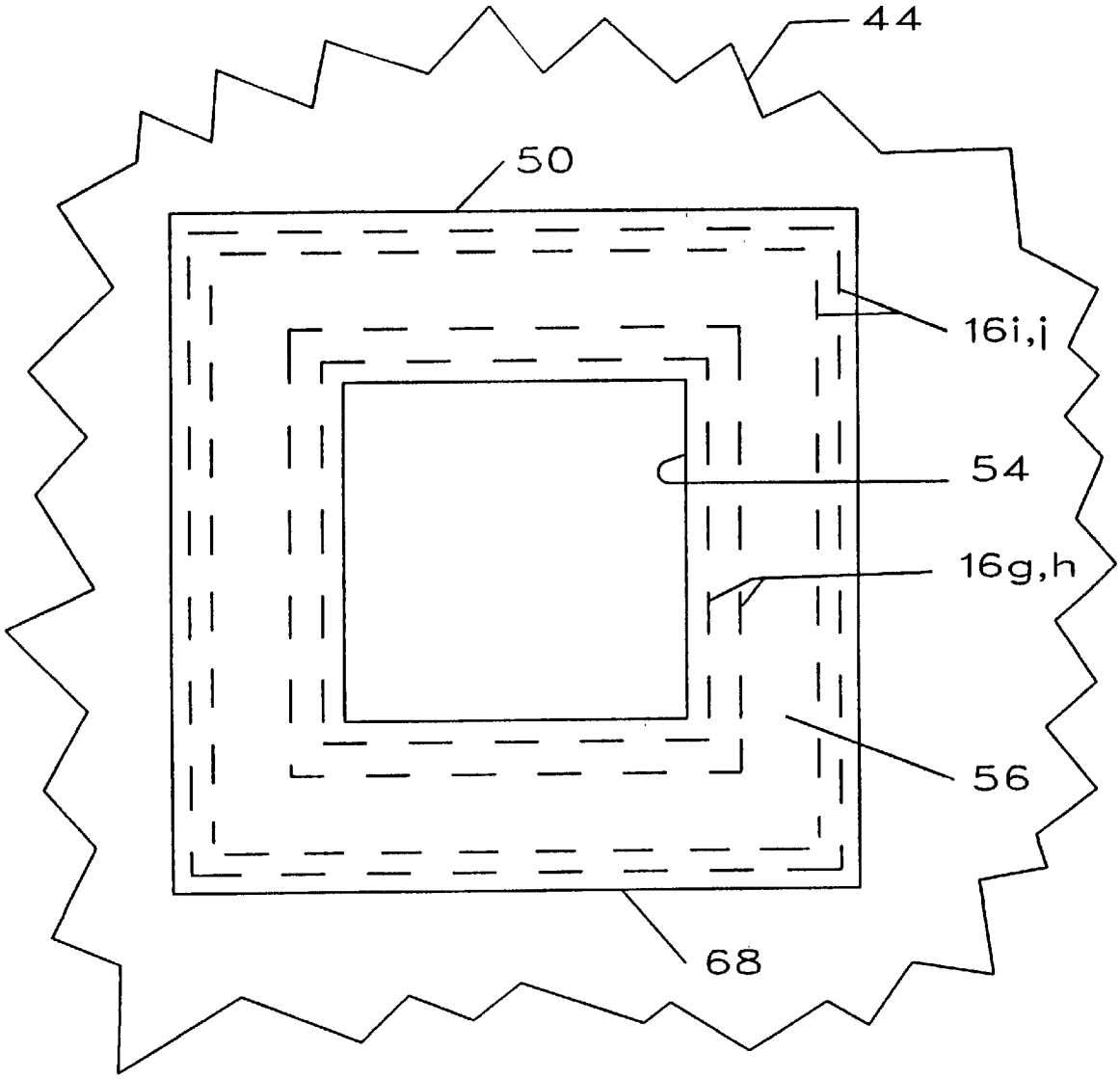
FIG. 11B is a front view of the picture frame container permanently affixed onto an apparel.

Alternatively, as shown in FIG. 10E, the two pieces 66*a*–66*b* can be replaced by four triangular shapes 66*c*–66*f* placed at, and permanently affixed onto, each of the four corners of the square, clear, transparent and flexible sheet material 64.

Figure 12A:
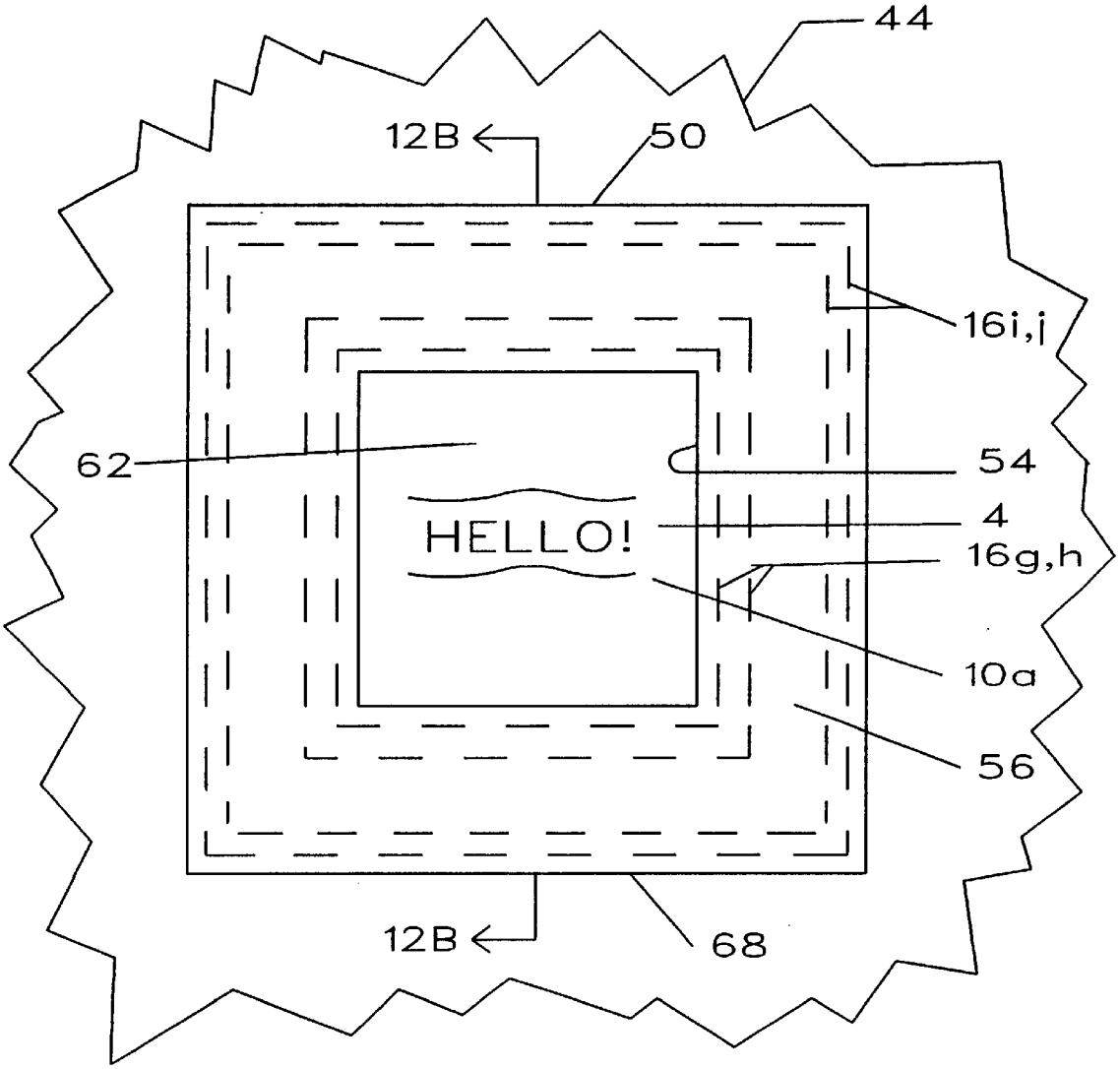
FIG. 12A is a front view of the picture frame container of FIG. 11 permanently affixed onto an apparel, with a laminated paper panel bearing an image inserted into the container.

Affixing the clear and flexible underlying container 62 (after an interchangeable and reversible laminated paper panel section 4 has been inserted into the two holding slots formed by pieces 66*a* and 66*b*) onto an apparel 44 is very simple. All one has to do is insert the underlying container 62 within the orifice 54, afterwards aligning together the two part affixing means 58*a*–58*d* and 60*a*–60*d* of the picture frame container 68 and of the underlying container 62, pressing them together, while making sure that there are no gaps or bad alignments. When finished, the interchangeable and reversible laminated paper panel section 4 shows an imprinted image 10*a* facing through the square-shaped orifice 54 of the picture frame container 56 as shown in FIGS. 12A and 12B.

To remove the underlying container 62 from the picture frame container 56 for the purpose of washing or dry cleaning the apparel or to remove the laminated paper panel section 4, or to interchange the said panel section 4 with a different said panel section 4, simply pull completely apart the two-part affixing means 58*a*–58*d* and 60*a*–60*d* (as joined in FIG. 12B), and afterwards remove the underlying container 62 from within the orifice 54, then wash or dry clean the apparel, or interchange the laminated paper panel section 4 with a new one, or reverse laminated paper panel section 4, afterwards affixing the underlying container 62 back onto the apparel 44 by following the above process in a reversed manner.

Figure 12B:
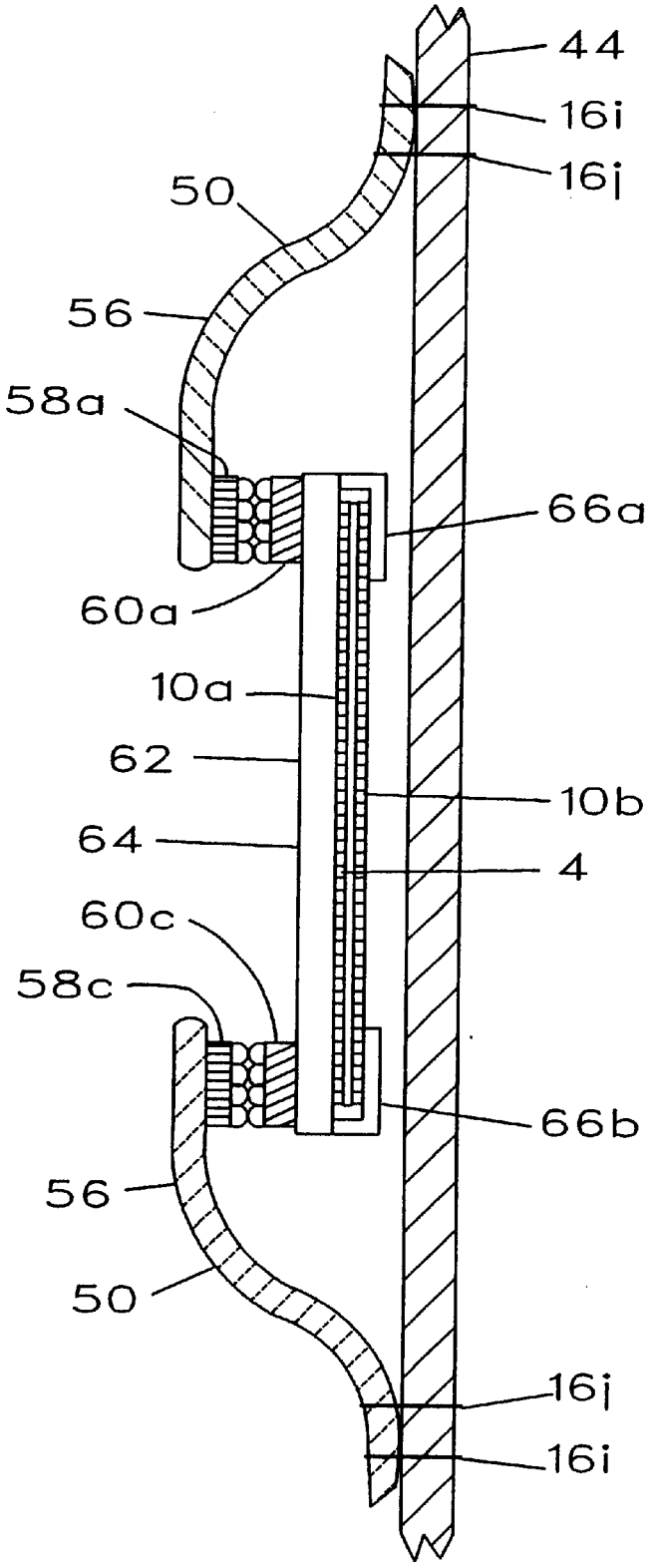
FIG. 12B is a cross-sectional view of FIG. 12A, taken on line 12B—12B.

As seen in the cross-sectional view of FIG. 12B, the fastening means 58*a*–58*d* and 60*a*–60*d*, respectively, on the picture frame section 56 and on the clear and flexible sheet material underlying container 62, when fastened, are completely closed, and the laminated paper panel section 4 is, therefore, in no danger of being accidentally lost.

Additionally, in each illustration, the loops-part of the affixing system is shown in place on the perimeter of the frame section. However, hooks-part can likewise be placed on the perimeter of the frame section, and the loops-part can be placed on the underlying container. Also, any type of fastening means could be implemented to affix the underlying container section to the apparel, for instance fastening means such as snaps, mild adhesive (such as that used on 3M's Highland Brand Self-Stick Removable Notes), and the like.

Although one aim of the present invention is to design and construct an apparel that incorporates a panel 4 without requiring a two-part affixing means, I would like to propose another modification of the present invention, more specifically providing an reversible picture frame container for apparels that are reversible. The proposed modification of the present invention does however employ a two-part affixing means, which is to be explained next.

Figure 13A:
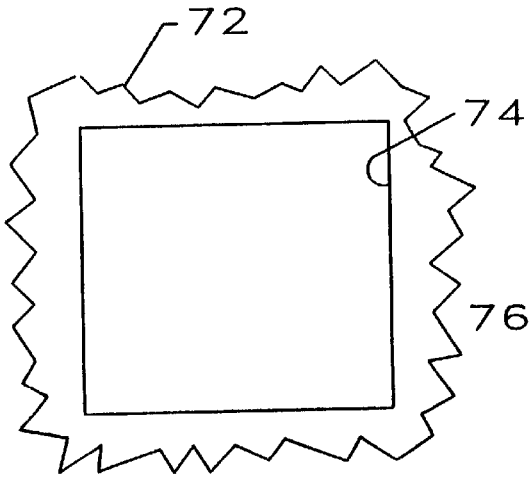
FIGS. 13A–13C are views that illustrate process steps for preparing a reversible apparel of the present invention, more specifically cutting an orifice in the apparel.
Figure 13B:
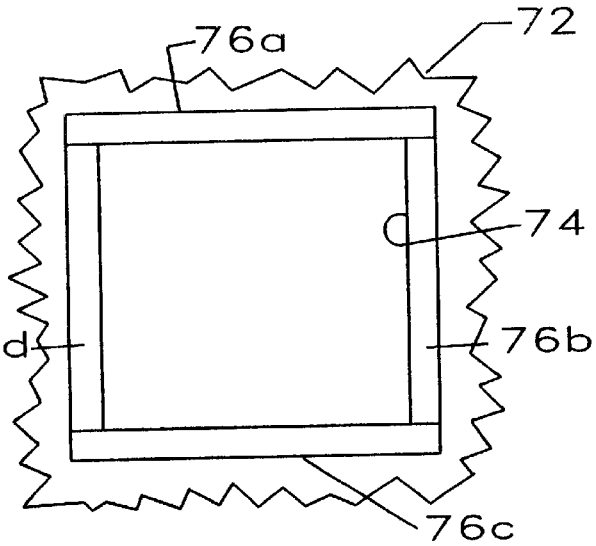
Figure 13C:
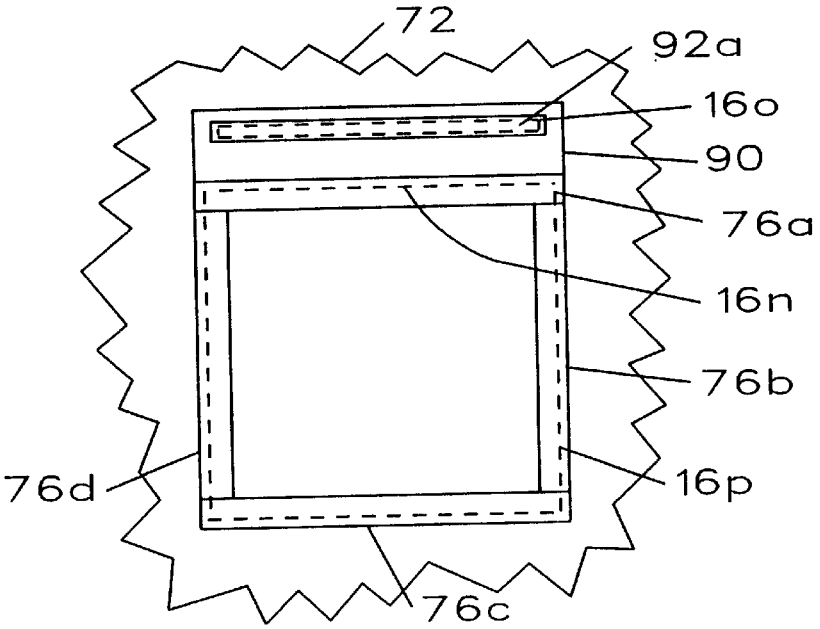

FIGS. 13A–C illustrate steps in a process for making the modified picture frame container and a reversible apparel 72. A square shape orifice 74 of desired measurement is cut into an apparel 72 that is reversible, which is to say, the apparel is one which can be turned inside out and worn to present an alternative coloration, patterning, etc. to that presented when the apparel is worn outside out. The raw edges of the square shape 74 are then covered in a circumferential manner with four strips of bias tape (the bias tape can be single or double fold) 76*a*–76*d* of a desired length and width (FIG. 13B).

A prepared flap 90 is then interposed between the apparel 72 and the top side of bias tape 76*a*. Afterwards they are stitched with a line of stitching 16*n*. The flap 90 has a hook-elements band 92*a* attached with stiching 16*o* to its underside.

Next, the border of each bias tape 76*b*–76*d* is joined to the apparel with a line of stitching 16*p* as seen in FIG. 13C.

Figure 14B:
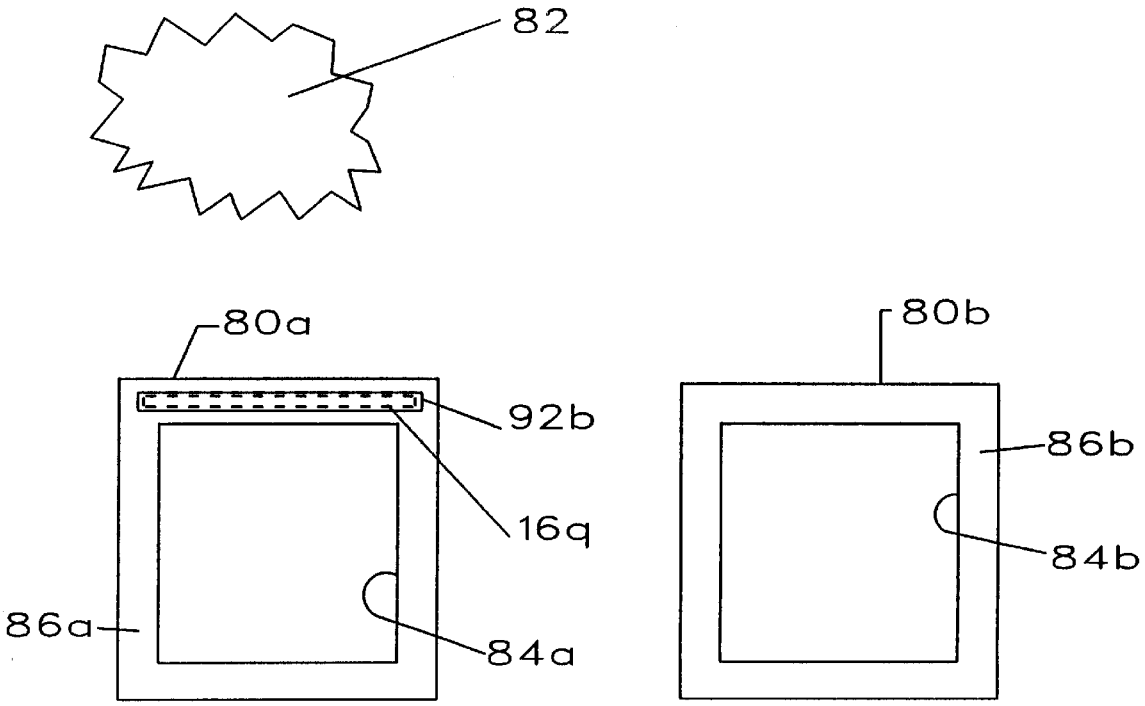
FIGS. 14A–14D show views illustrating process steps for designing and constructing a reversible picture frame container.
Figure 14A:
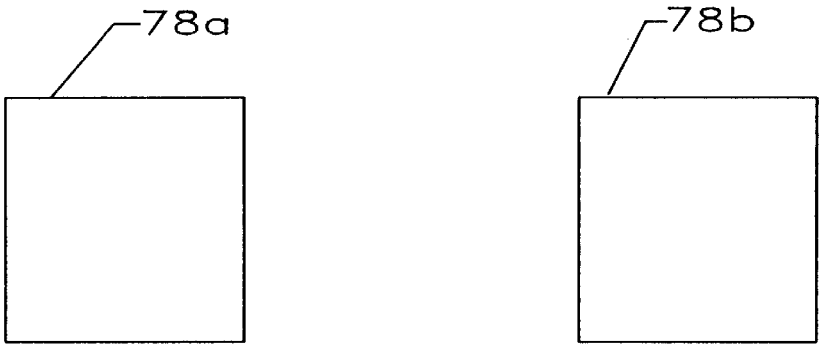

FIG. 14A shows two pieces of clear, transparent and flexible sheet material 78*a* and 78*b*, fashioned into a square or rectangular shape of desired width and length. Two square-shaped panels 80*a*–80*b* of desired measurements are cut from a desired non-fraying fabric 82. Then a square shaped orifice 84*a*–84*b* is made in the center of the two square panels 80*a*–80*b* to form two fabric frames 86*a*–86*b*. A band of loops elements 92*b* is placed on fabric frame 86*a* and afterwards stitched along its edges in circumferential manner with a line of stitching 16*q* as in FIG. 14B. Each of the square-shaped clear and flexible sheet materials 78*a*–78*b* is then positioned and placed on the top surface of the fabric frames 86*a*–86*b*, in the centers of the fabric frames 86*a*–86*b* (FIG. 14C).

Figure 14C:
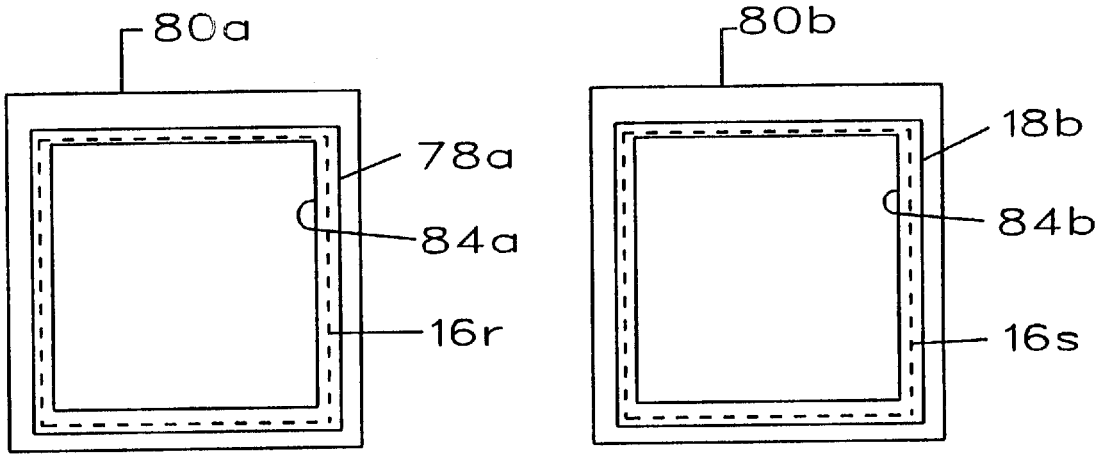
Figure 14D:
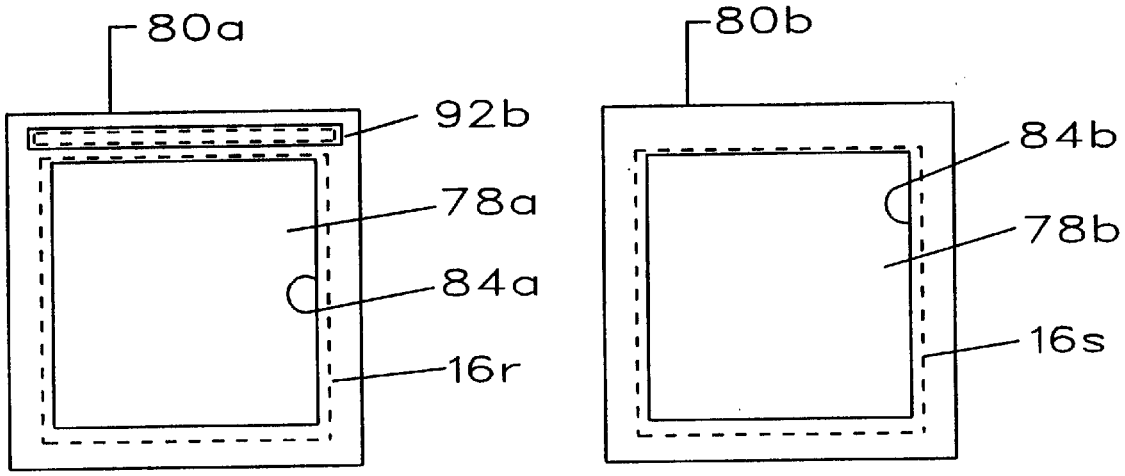

It is very important to note, that the two square clear and flexible sheet materials 78*a*–78*b* are a little larger than the two square-shaped orifices 84; therefore, the edges of the orifices 84 of the fabric frames 86*a*–86*b* can seen as separate lines (FIG. 14C). Next, the edges of the two, square-shaped, clear, transparent and flexible sheet materials 78*a*–78*b* are stitched to their respective frames 86*a*–86*b* with a line of stitching 16*r*–16*s* in a circumferential manner as shown in FIG. 14C. FIG. 14D shows views of the resulting window frame assemblies from the front side.

The two frames 86*a*–86*b* are then marked with a tracing pencil to the same exact size of the orifice 74 on the apparel 72. Afterwards, they are placed and positioned evenly together, then stitched with a line of stitching 16*t* on the tracing line in the center along the vertical and bottom sides as seen in FIGS. 15B and 15C.

Figure 15A:
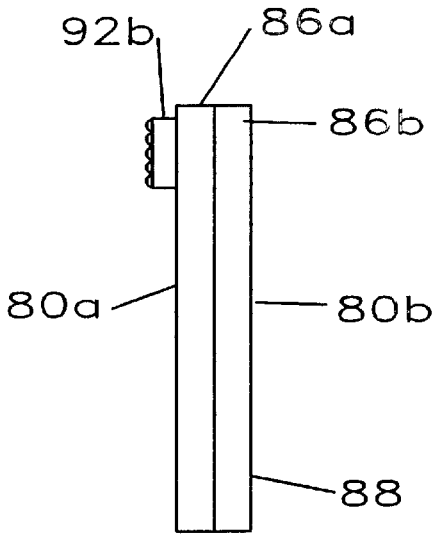
FIGS. 15A–15B are, respectively, side and elevational views illustrating a finished reversible picture frame container.
Figure 15B:
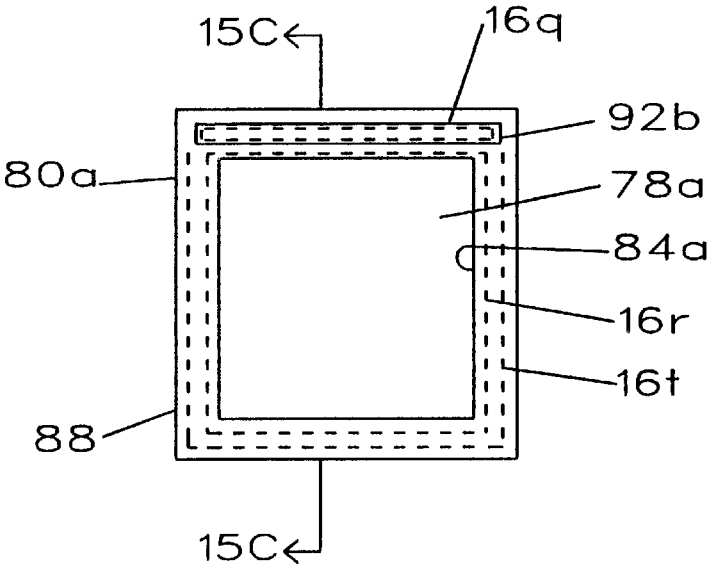
Figure 15C:
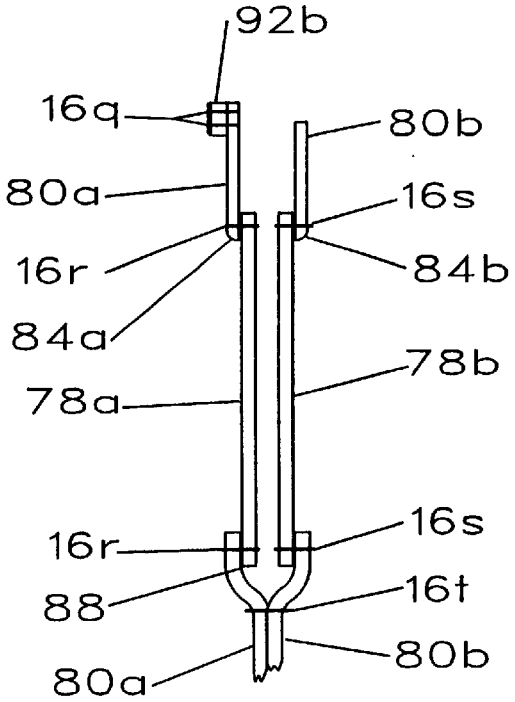
FIG. 15C is a cross-sectional view of FIG. 15B, showing a finished assembly of the picture frame container taken on line 15C—15C, on an enlarged scale.

It is very important to note that when the two fabric frames 86*a*–86*b* are joined together, they become what I have termed a reversible picture frame container 88 (FIGS. 15A–C).

Figure 16:
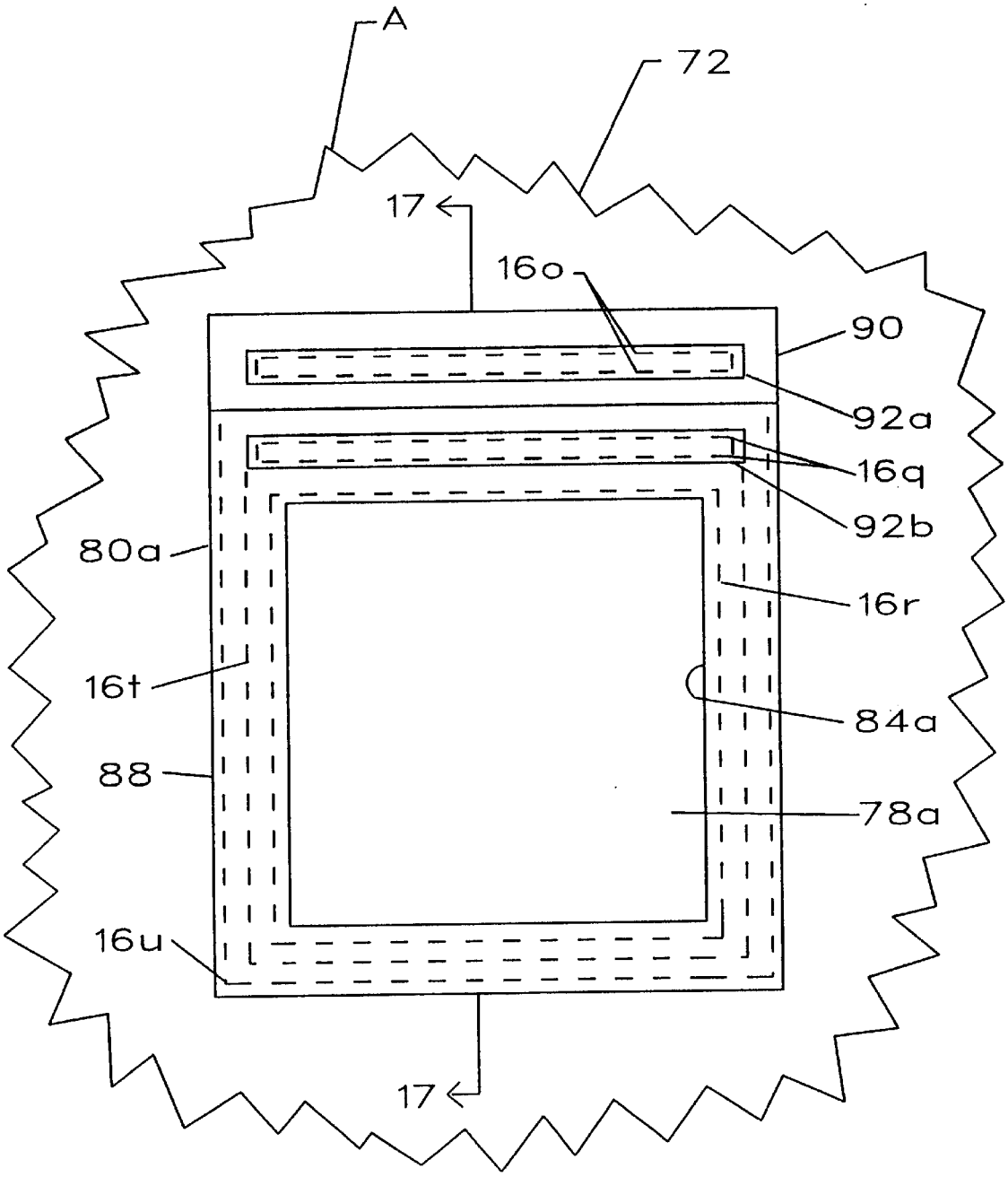
FIG. 16 is a front view of the picture frame container being placed and positioned within the orifice of the apparel.
Figure 17:
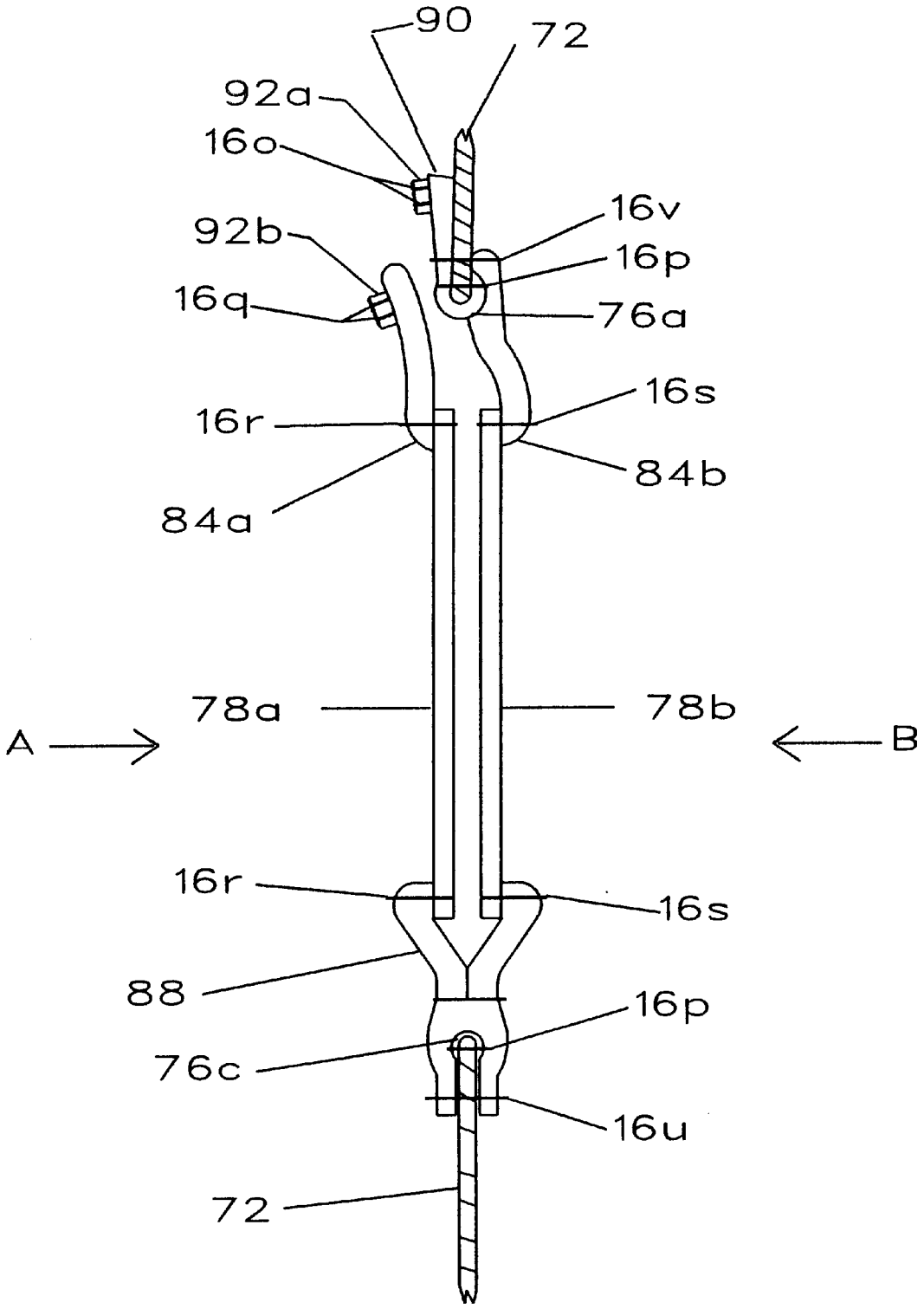
FIG. 17 is a cross-sectional view of FIG. 16, which shows an assembly of the picture frame container with a reversible apparel taken on line through 17—17, on an enlarged scale.
Figure 18:
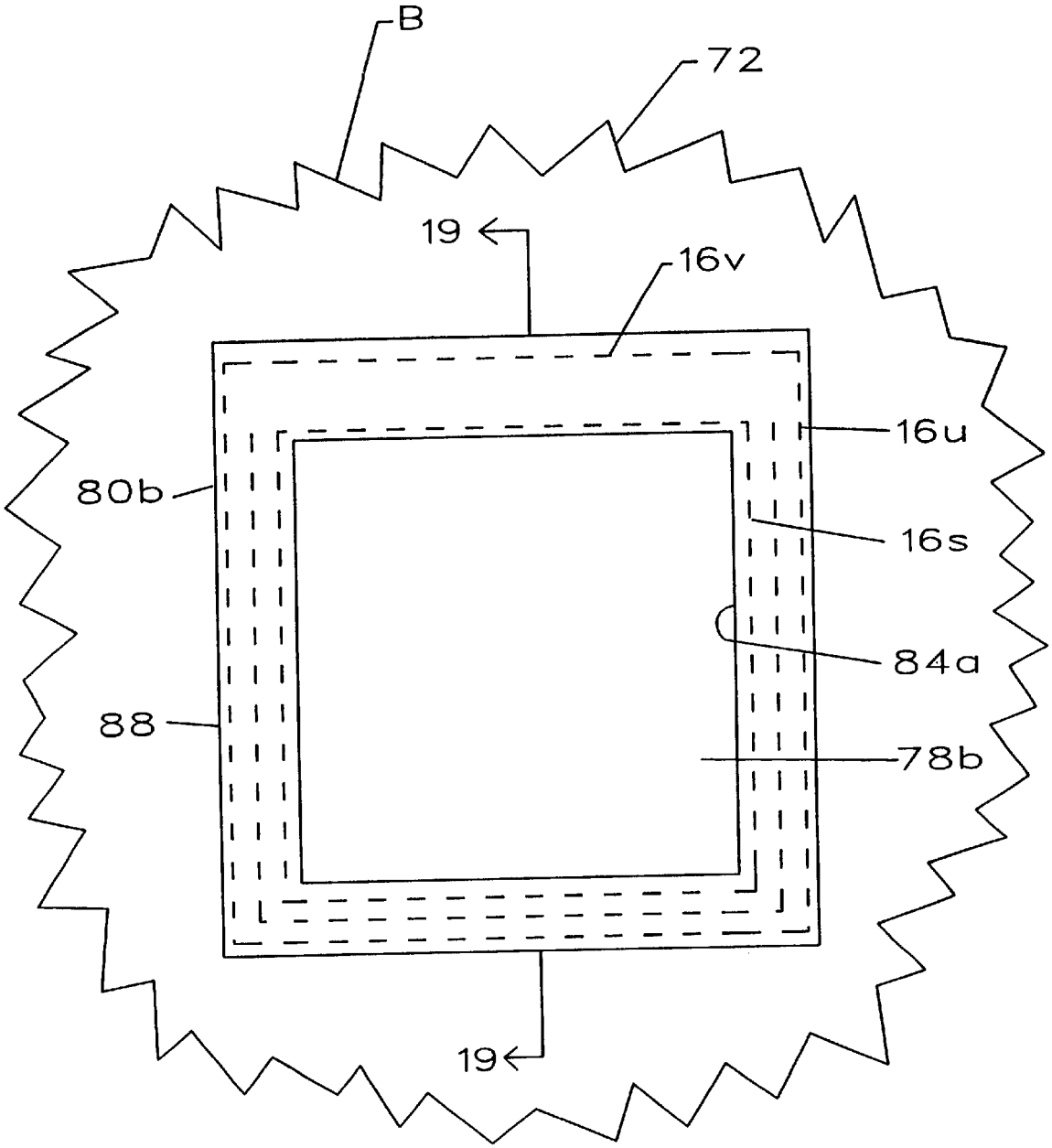
FIG. 18 is a front view of the picture frame container looking onto the B side of the reversible apparel.

FIG. 17 is a cross-sectional view of FIGS. 16 and 18. These Figs. show the reversible picture frame container 88 being placed and positioned at the orifice 74 on the apparel 72. After the reversible picture frame container 88 is positioned and placed within the orifice 74, a line of stitching 16*u* is added along the border of the reversible picture frame container's vertical and bottom sides. The dimensions of the reversible picture frame container 88 and orifice 74 are coordinated, such that, when the reversible frame container 88 is placed and positioned within the orifice 74, it will fit tightly and evenly, in co-planar relationship, with the bias tape edges 76*a*–76*d*, as seen in the cross-sectional view of FIG. 17. Also the borderline edges of the reversible frame container 88 should completely overlap the bias tapes 76*a*–76*d* located on the vertical, top and bottom sides of the orifice 74.

Another noteworthy, important element must be that, since the apparel is reversible, it has to have the capability of two side usage. Therefore, from here on, I will use the letter A for referring to outside usage of the apparel 72 and B for the inside, for the purpose of explaining further, more specifically the designs and constructions of the reversible apparel 72 and the reversible picture frame container 88 of the present invention.

Figure 19:
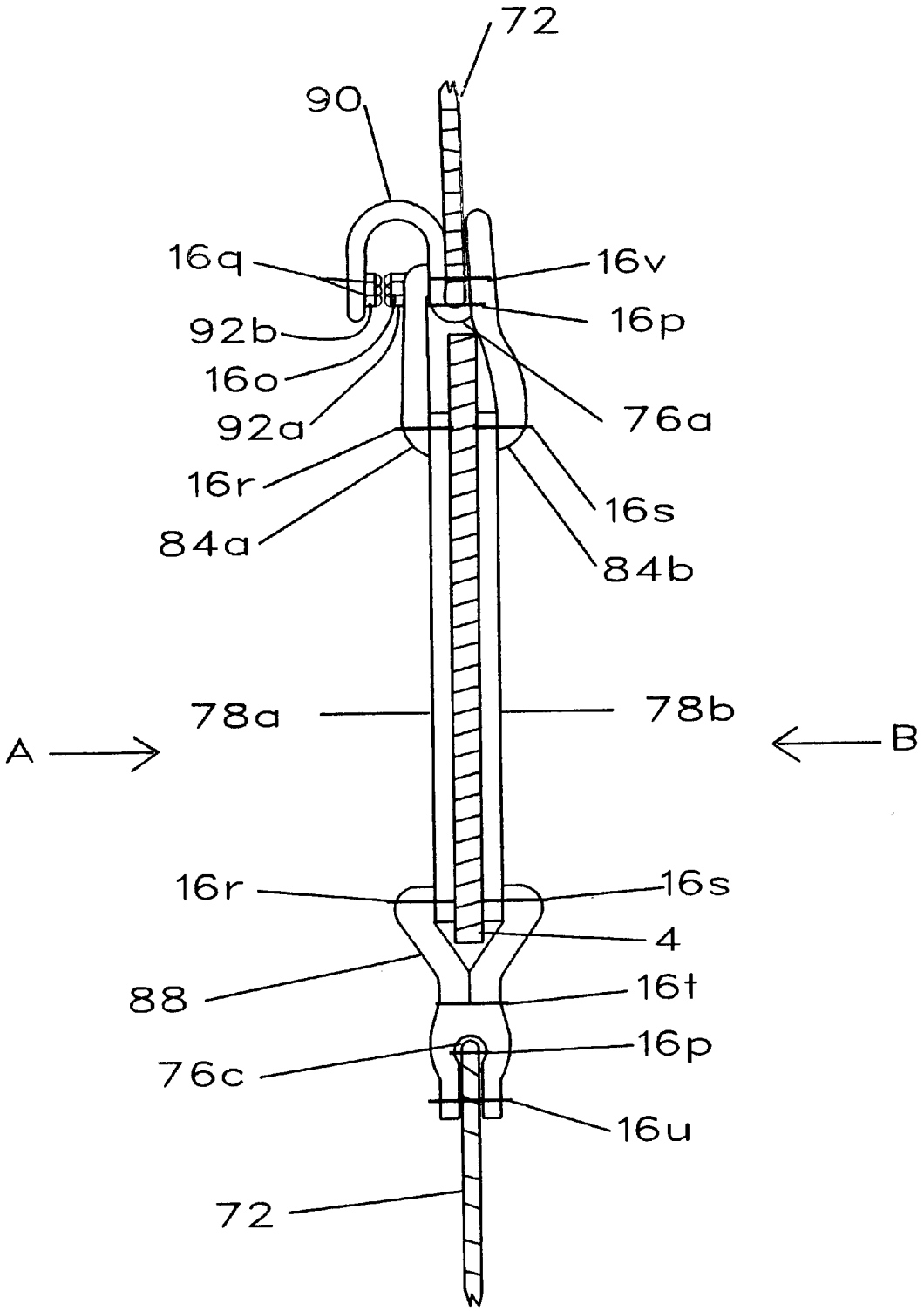
FIG. 19 is a cross-sectional view of FIG. 18, showing two side usage of the reversible picture frame container and the reversible apparel, taken on line 19—19, on an enlarged scale.

FIG. 19 shows both the A and B sides of the apparel 72. The top side of the reversible picture frame container 88 on the B side of the apparel 72 at this point can be stitched with a line of stitching 16*v* as seen in FIGS. 17–19. The top side of the reversible picture frame container 88 on the A side of the apparel 72 in FIG. 17 requires no stitching; it will remain open, so that an interchangeable and reversible laminated paper panel section 4 can be inserted within it.

When an interchangeable and reversible laminated paper panel section 4 has been inserted within the opening of the reversible picture frame container 88, the flap 90 is then closed and sealed by pressing the hooks 92*a* and loops 92*b* elements of the VELCRO fastener together (FIG. 19). An image on the laminated paper panel section can now be viewed through the clear and flexible sheet material 78*a* of the reversible picture frame container 88, when the apparel is wore with side A out. If the wearer wants to wear the apparel 72 with the B side out, the image on the other side of laminated paper panel section 4 is then seen through the clear and flexible sheet material 78*b*.

In developing the present invention, it was found that there are certain types of clear, transparent and flexible, sheet materials that do not work as well when they where incorporated into the invention. Briefly, such sheet materials that are softer (for instance, S-Hand Vinyl), when used in the present invention, can cause a watery-like-substance (moisture) to appear upon contact with the image-bearing, laminated panel sections. This substance, when it occurs, causes the images on the panel section to be distorted and misrepresented, because the images on the panel section can not be clearly seen. It is believed that this substance occurs because some clear sheet materials (S-Hand version) contain increased amounts of softening agents or plastersizers which can migrate to the surface of the material. Such softened, clear sheet material (S-Hand version) should not be incorporated with the present invention when using laminated paper panel sections. In order to eliminate this watery-like substance (moisture) from appearing in between the clear sheet material and the laminated paper panel bearing images, a harder, but yet soft and flexible sheet material (H1 to H-3 Hand Vinyl versions) is preferred for use in the present invention. These types of clear materials have less softening agents (plastersizers) in them, and because of this, the watery-like substance (moisture) does not occur, therefore the images on panel sections will not be distorted. A preferred clear, transparent and flexible sheet material for use in the present invention is "H" Hand Vinyl sheet of h-1 rating, as available, for example, from Tamarack Packaging Ltd., Meadville, Pa.

Interchangeable and removable laminated paper panel sections will have a great affect on the apparel industry, more particularly by providing apparels that embody imprints by way of screen printing, embroidery, etc. Thus, images imprinted on paper by various known printing means are much better than images imprinted on fabric. Images imprinted on paper have much more clarity; are more fascinating; sharper, and inexpensive to mass produce. Plus, the lamination of the paper with printed images will most definitely be more durable than fabric with printed images. Also it is much easier and faster to print an image, such as logo or pictorial matter, on paper than it is to print on fabric.

While the present invention has been set forth in association with specific embodiments therof, it is evident that many alternatives will be noticeable to those skilled in the art in view of the forgoing description, as well as certain changes in the form and the arrangements of parts. For an example, the frame that surrounds the clear and flexible sheet material can be formed from the same material, instead of fabric. The frame can also be bonded around the clear, transparent and flexible material by heat sealing it with a heat sealer. Accordingly, although it was suggested that laminated paper panel be used in accordance with present invention, panels made from fabrics or any type of material that is flexible can be imprinted and likewise be inserted within each of the picture frame containers' inner pocket or pouch, afterwards to be displayed through the clear and flexible sheet material. Also, it will be apparent that the above text and the drawings provide the basis whereby, optionally, a picture frame container and laminated paper panel sections kit, along with instructions, can be offered separately, so that it can be purchased by an individual for the purpose of incorporating it into an apparel of their own choice. Accordingly, the present invention is meant to comprise all such alternatives, modifications and variations as fall within the spirit and scope of the appended claims and equivalents sanctioned by the laws of patents.

What is claimed is:

1. An article having a container and a window of transparent sheet material on the container, whereby an image may be placed in the container and viewed through the window, the sheet material being a material which exhibits a moisture-free contact between itself and a laminated image.

2. An article as claimed in claim 1, the article comprising an apparel.

3. An article as claimed in claim 1, further including a laminated image in the container and showing through the window.

4. An article as claimed in claim 3, the window being of "H" hand vinyl plastic sheet material.

5. An article as claimed in claim 3, orientation of the laminated image in the container being controlled by internal boundaries of the container.

6. An article as claimed in claim 3, the article having an inside, the container having an opening inside the article for inserting the laminated image into the container for displaying the image through the window.

7. An article as claimed in claim 6, the container having, above the opening, material which may be pulled over the laminated image once the laminated image has been inserted through the opening into the container for keeping the laminated image in the container.

8. An article as claimed in claim 3, the article comprising an apparel.

9. An article as claimed in claim 8, the laminated image comprising an image selected from the group consisting of pictures or photos of movie, music or sports stars; friends or family, slogans, or artistic designs.

10. An article as claimed in claim 1, further comprising a frame around the container, the window being within the frame.

11. An article as claimed in claim 10, the container being releasably attached to the frame.

12. An article as claimed in claim 11, further comprising bands of hooks and loops for providing the releasable attachment.

13. An article as claimed in claim 10, wherein: the frame (18*a–d*) is connected to the window (6) to make a window frame (20); the window frame is connected along a rectangular circumference (16*d*) to the article, in order to form the container between the window frame and the article; and the article contains an opening (28) into the container, for insertion of an image-bearing panel into the container for display of the image through the window.

14. An article as claimed in claim 10, wherein: the frame (40*b–e*) is connected to the window (6) to make a window frame (41); the window frame is connected along a rectangular circumference (16*f*) to the article, in order to form the container between the window frame and the article; and the window frame contains a closable opening (38) into the container, for insertion of an image-bearing panel into the container for display of the image through the window.

15. An article having a container, a frame around the container, and a window of transparent sheet material within the frame and on the container, whereby an image may be placed in the container and viewed through the window, the article being reversible such that it can have states of right side out or inside out, the article including an additional window of transparent sheet material on the container, whereby a panel in the container having images on two sides is viewable in either of the states of the article, right side out or inside out.

16. An article having a container, a frame around the container, and a window of transparent sheet material within the frame and on the container, whereby an image may be placed in the container and viewed through the window, the container being sized to carry a plurality of panels bearing images, whereby alternate images are selectable for display through the window.

17. An article having a container, a frame around the container, and a window of transparent sheet material within the frame and on the container, whereby an image may be placed in the container and viewed through the window, wherein: the frame (56) is connected to the article; the window (64) is provided on a cassette (62); the cassette has space behind the window for the image; and the cassette is releasably connected to the frame; the container being formed by the window, the frame and the article.

18. An article having a container, a frame around the container, and a window of transparent sheet material within the frame and on the container, whereby an image may be placed in the container and viewed through the window, wherein: the article has an orifice (74); there are two frames (86*a,b*) and two windows (78*a,b*), and each frame is connected to its own one of the windows to make two window frames; and the window frames are connected along the orifice, in order to form the container between the window frames.

* * * * *